US009638153B2

(12) United States Patent
Ulrey et al.

(10) Patent No.: US 9,638,153 B2
(45) Date of Patent: May 2, 2017

(54) METHOD FOR COOLING A DIRECT INJECTION PUMP

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 110 days.

(21) Appl. No.: 14/627,973

(22) Filed: Feb. 20, 2015

(65) Prior Publication Data

US 2016/0245218 A1 Aug. 25, 2016

(51) Int. Cl.

| | |
|---|---|
| ***F02M 59/46*** | (2006.01) |
| ***F02M 59/02*** | (2006.01) |
| ***F02D 41/38*** | (2006.01) |

(52) U.S. Cl.

CPC ..... *F02M 59/466* (2013.01); *F02D 41/3845* (2013.01); *F02M 59/022* (2013.01); *F02M 59/025* (2013.01); *F02M 59/462* (2013.01)

(58) Field of Classification Search

CPC .. F02D 41/3082; F02D 41/2406; F02D 41/26; F02M 59/466; F02M 59/022; F02M 59/025

See application file for complete search history.

(56) References Cited

U.S. PATENT DOCUMENTS

| | | | | |
|---|---|---|---|---|
| 4,625,701 | A * | 12/1986 | Bartlett | F02M 31/16 123/510 |
| 5,755,211 | A * | 5/1998 | Koch | F02D 19/0647 123/525 |
| 5,986,871 | A * | 11/1999 | Forck | F02D 41/20 361/154 |
| 6,167,869 | B1 * | 1/2001 | Martin | F02M 57/023 123/458 |
| 6,230,688 | B1 * | 5/2001 | Faix | F02D 41/3809 123/196 R |
| 6,422,203 | B1 * | 7/2002 | Djordjevic | F02D 41/3082 123/456 |
| 6,494,182 | B1 * | 12/2002 | Djordjevic | F02D 41/3082 123/447 |
| 6,530,363 | B1 * | 3/2003 | Blass | F02M 39/00 123/446 |
| 6,637,408 | B2 * | 10/2003 | Djordjevic | F02D 41/3082 123/449 |
| 6,742,479 | B2 * | 6/2004 | Yanagisawa | F02M 63/0225 123/1 A |
| 6,748,923 | B2 * | 6/2004 | Grossner | F02M 37/0029 123/446 |
| 7,263,973 | B2 * | 9/2007 | Akita | F02D 41/3094 123/299 |

(Continued)

*Primary Examiner* — Joseph Dallo

(74) *Attorney, Agent, or Firm* — Julia Voutyras; McCoy Russell LLP

(57) ABSTRACT

Methods and systems are provided for cooling a high pressure fuel pump. One method includes, when a spill valve is in a pass-through state, circulating fuel from a compression chamber of the high pressure fuel pump to a step room of the high pressure fuel pump. The fuel circulation through the step room may provide for a reduction in fuel temperature in the step room, and thus, the high pressure fuel pump.

16 Claims, 8 Drawing Sheets

(56) References Cited

U.S. PATENT DOCUMENTS

| | | | | |
|---|---|---|---|---|
| 7,770,562 | B2 * | 8/2010 | Pursifull | F02M 37/0088 123/446 |
| 7,954,477 | B2 * | 6/2011 | Gruber | F02D 19/087 123/381 |
| 8,078,386 | B2 * | 12/2011 | Stein | F02D 19/081 123/198 F |
| 8,371,267 | B2 * | 2/2013 | Kristen | 123/446 |
| 8,590,510 | B2 * | 11/2013 | Surnilla | F02M 39/02 123/431 |
| 8,776,764 | B2 * | 7/2014 | Basmaji | F02D 19/0605 123/27 GE |
| 9,303,605 | B2 * | 4/2016 | Marriott | F02M 43/02 |
| 2003/0034011 | A1 * | 2/2003 | Djordjevic | F02D 41/3082 123/447 |
| 2011/0023832 | A1 * | 2/2011 | Brown | F02M 31/20 123/456 |
| 2011/0155102 | A1 * | 6/2011 | Ten Broeke | F02D 19/0605 123/446 |
| 2011/0290203 | A1 * | 12/2011 | Pursifull | F02D 19/0605 123/41.08 |
| 2012/0312280 | A1 * | 12/2012 | Jaasma | F02D 19/0647 123/456 |
| 2013/0118449 | A1 | 5/2013 | Marriott et al. | |
| 2015/0354491 | A1 * | 12/2015 | Ulrey | F02M 63/0001 123/294 |

* cited by examiner

METHOD FOR COOLING A DIRECT INJECTION PUMP

FIELD

The present application relates generally to cooling a direct injection fuel pump in fuel systems in internal combustion engines.

SUMMARY/BACKGROUND

Port fuel direct injection (PFDI) engines include both port injection and direct injection of fuel and may advantageously utilize each injection mode. For example, at higher engine loads, fuel may be injected into the engine using direct fuel injection for improved engine performance (e.g., by increasing available torque and fuel economy). At lower engine loads and during engine starting, fuel may be injected into the engine using port fuel injection to provide improved fuel vaporization for enhanced mixing and to reduce engine emissions. Further, port fuel injection may provide an improvement in fuel economy over direct injection at lower engine loads. Further still, noise, vibration, and harshness (NVH) may be reduced when operating with port injection of fuel. In addition, both port injectors and direct injectors may be operated together under some conditions to leverage advantages of both types of fuel delivery or in some instances, differing fuels.

In PFDI engines, a lift pump (also termed, low pressure pump) supplies fuel from a fuel tank to both port fuel injectors and a direct injection fuel pump (also termed, a high pressure pump). The direct injection fuel pump may supply fuel at a higher pressure to direct injectors. During operation, one or more hot spots may be formed on a bottom surface of a pump piston within the direct injection fuel pump. As such, fuel may be exposed to the bottom surface of the pump piston when residing within or flowing through a chamber (herein termed a step room) formed underneath the bottom surface of the pump piston. Accordingly, fuel may be heated leading to fuel vaporization within the step room. Further, the evaporation of fuel may overheat the step room and may increase a likelihood of the pump piston seizing within a bore of the direct injection fuel pump.

An example approach shown by Marriott et al. in US 2013/0118449 enables cooling of the step chamber via fuel circulation. Herein, fuel from a low pressure fuel supply line is circulated to the step room of the direct injection fuel pump and thereupon returned to the low pressure fuel supply line upstream of an accumulator. Further, the flow of fuel through the step room is primarily driven by a change in volume of the step room due to pump piston motion.

The inventors herein have recognized a potential issue with the example approach of Marriott et al. For example, a direct injection fuel pump may include a pump piston coupled to a piston stem of substantially the same exterior diameter as the pump piston. By using a piston stem with a similar exterior diameter as the pump piston, pump reflux from the step room may be reduced. In this case, the volume of the step room may not vary significantly during pump strokes. Further, without a significant change in the volume of the step room, fuel circulation through the step room may be reduced, and step room cooling may not occur.

The inventors herein have recognized the above issue and identified an approach to at least partly address the above issue. In one example approach, a method may comprise, when a spill valve is in a pass-through state, circulating a portion of fuel from a compression chamber of a direct injection pump to a step room of the direct injection pump, the circulating including flowing the portion of fuel through the spill valve and drawing the portion of fuel into the step room from upstream of the spill valve and downstream of an accumulator. In this way, the step room may be cooled by reflux fuel from the compression chamber.

In another example approach, a system may comprise an engine, a lift pump, a direct injection fuel pump including a piston coupled to a piston stem, a compression chamber, a step room, and a cam for driving the piston, a high pressure fuel rail fluidically coupled to an outlet of the direct injection fuel pump, a solenoid activated check valve positioned at an inlet of the direct injection fuel pump, a fuel supply line fluidically coupling the lift pump and the solenoid activated check valve, an accumulator positioned upstream of the solenoid activated check valve, the accumulator fluidically communicating with the fuel supply line, a first check valve coupled to the fuel supply line between the accumulator and the solenoid activated check valve, a first fuel conduit including a second check valve, a first end of the first fuel conduit fluidically coupled to the fuel supply line between the first check valve and the solenoid activated check valve, a second end of the first fuel conduit fluidically coupled to an inlet of the step room, a second fuel conduit, a first end of the second fuel conduit fluidically coupled to an outlet of the step room, and a second end of the second fuel conduit fluidically coupled to the fuel supply line at the accumulator upstream of the first check valve and downstream of a third check valve. This example system may enable isothermal fuel flow through the direct injection fuel pump.

For example, a direct injection (DI) fuel pump of a fuel system in a PFDI or a DI engine may include a compression chamber, a pump piston coupled to a piston stem, and a step room. In one example, the piston stem may have an external diameter that is substantially equal to an external diameter of the pump piston. The DI fuel pump may receive fuel into its compression chamber via a fuel supply line from a lift pump. An electronically controlled solenoid activated check valve, fluidically coupled to the fuel supply line, may be arranged at an inlet of the compression chamber of the DI fuel pump. An accumulator may be positioned upstream of the solenoid activated check valve to store fuel during a compression stroke in the DI fuel pump. A first check valve located between the accumulator and the solenoid activated check valve may obstruct fuel flow from the solenoid activated check valve to the accumulator while allowing fuel flow from the accumulator towards the solenoid activated check valve. Further, the step room may fluidically communicate with the fuel supply line via each of a first fuel conduit and a second fuel conduit. The first fuel conduit may fluidically couple an inlet of the step room to the fuel supply line between the first check valve and the solenoid activated check valve. The second fuel conduit may enable fluidic communication between an outlet of the step room and the fuel supply line at the accumulator. Further, a third check valve may be coupled to the fuel supply line downstream of the lift pump and upstream of a node where the second fuel conduit merges with the fuel supply line at the accumulator. Thus, when the solenoid activated check valve is de-energized to a pass-through state, a quantity of fuel (e.g., reflux fuel) may exit the compression chamber of the DI fuel pump through the solenoid activated check valve. As such, the quantity of fuel may exit the compression chamber during a compression stroke in the direct injection fuel pump. Since the first check valve impedes fuel flow towards the accumulator, the quantity of fuel may initially flow to the step room via the first fuel conduit. The quantity of fuel may then flow from the step room towards the accumulator via the second fuel conduit. Thus, the circulatory flow of the quantity of fuel may cool the step room.

In this way, fuel heating within the step room of the DI fuel pump may be reduced. By flowing fuel from the compression chamber to the step room, pump strokes within the compression chamber (and not within the step room) may drive fuel flow through the step room. Thus, fuel within the DI fuel pump may be maintained substantially isothermal. By reducing fuel heating in the step room, fuel vaporization within the step room may be diminished leading to enhanced DI fuel pump performance. Overall, durability of the DI fuel pump may be extended, and maintenance costs may be decreased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
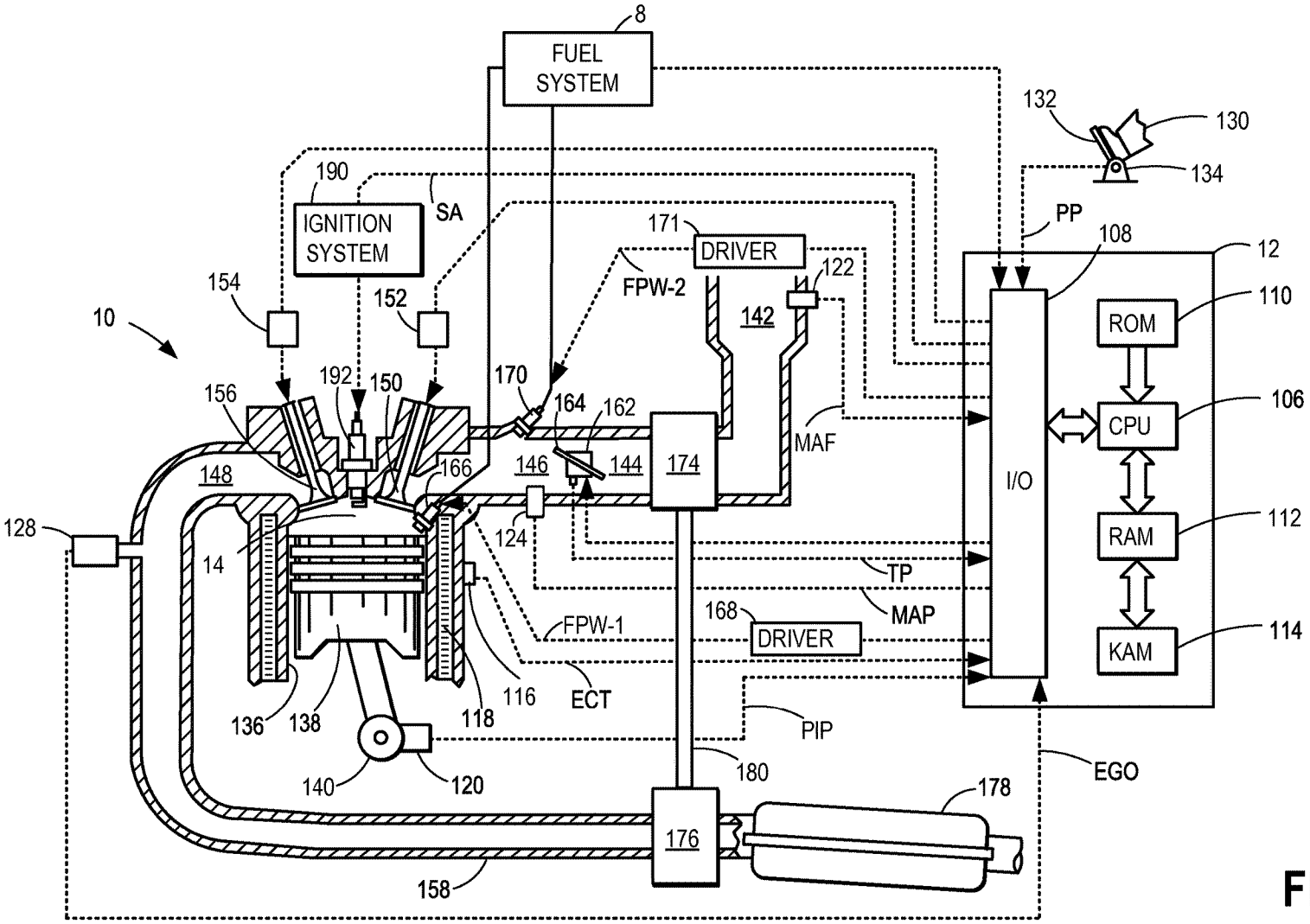
FIG. 1 schematically depicts an example embodiment of a cylinder in an internal combustion engine.

In port fuel direct injection (PFDI) engines, a fuel delivery system may include multiple fuel pumps for providing a desired fuel pressure to the fuel injectors. As one example, the fuel delivery system may include a lower pressure fuel pump (or lift pump) and a higher pressure (or direct injection) fuel pump arranged between a fuel tank and fuel injectors. The higher pressure fuel pump may be coupled upstream of a high pressure fuel rail in a direct injection system to raise a pressure of the fuel delivered to engine cylinders through direct injectors. A solenoid activated inlet check valve, solenoid activated check valve, or spill valve, may be coupled upstream of the high pressure (HP) pump to regulate fuel flow into a compression chamber of the high pressure pump. The spill valve is commonly electronically controlled by a controller which may be part of a control system for the engine of the vehicle. Furthermore, the controller may also have a sensory input from a sensor, such as an angular position sensor, that allows the controller to command activation of the spill valve in synchronism with a driving cam that powers the high pressure pump.

The following description relates to systems and methods for cooling a direct injection (DI) fuel pump. The DI fuel pump may be included in a fuel system, such as the example fuel system of FIG. 2. Further, the fuel system may fuel an engine system such as the example engine system of FIG. 1. The DI fuel pump may be operated either in a variable pressure mode or in a default pressure mode (FIG. 7). The variable pressure mode may include energizing a solenoid activated check valve (SACV) to regulate fuel volume and pressure in a DI fuel rail. The default pressure mode may include de-energizing the SACV through an entire pump stroke. Fuel may be delivered to a compression chamber of the DI fuel pump during an intake stroke of the DI fuel pump (FIG. 4) from a lift pump and/or an accumulator located downstream of the lift pump. During either mode of pump operation, fuel from the compression chamber of the DI fuel pump (FIG. 3) may exit the compression chamber through the SACV when it is in a pass-through state. Specifically, fuel may exit the compression chamber through the SACV during a compression stroke in the DI fuel pump as reflux fuel. Further, the reflux fuel may flow from the SACV to a step room of the DI fuel pump (FIG. 5) and thereon towards the accumulator (FIG. 9). The flow of reflux fuel may be enabled by one or more check valves. These check valves may be replaced by bell mouth orifices, such as the example bell mouth orifice shown in FIG. 6. Fuel flow in the DI fuel pump of the present disclosure during each of the variable mode operation and default pressure mode operation is described in FIG. 8.

Regarding terminology used throughout this detailed description, a high pressure pump, or direct injection fuel pump, may be abbreviated as a HP pump (alternatively, HPP) or a DI fuel pump respectively. Accordingly, HPP and DI fuel pump may be used interchangeably to refer to the high pressure direct injection fuel pump. Similarly, a low pressure pump, may also be referred to as a lift pump. Further, the low pressure pump may be abbreviated as LP pump or LPP. Port fuel injection may be abbreviated as PFI while direct injection may be abbreviated as DI. Also, fuel rail pressure, or the value of pressure of fuel within the fuel rail (most often the direct injection fuel rail), may be abbreviated as FRP. The direct injection fuel rail may also be referred to as a high pressure fuel rail, which may be abbreviated as HP fuel rail. Also, the solenoid activated inlet check valve for controlling fuel flow into the HP pump may be referred to as a spill valve, a solenoid activated check valve (SACV), electronically controlled solenoid activated inlet check valve, and also as an electronically controlled valve. Further, when the solenoid activated inlet check valve is activated, the HP pump is referred to as operating in a variable pressure mode. Further, the solenoid activated check valve may be maintained in its activated state throughout the operation of the HP pump in variable pressure mode. If the solenoid activated check valve is deactivated and the HP pump relies on mechanical pressure regulation without any commands to the electronically-controlled spill valve, the HP pump is referred to as operating in a mechanical mode or in a default pressure mode. Further, the solenoid activated check valve may be maintained in its deactivated state throughout the operation of the HP pump in default pressure mode.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated in FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake air passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

In an alternate example, each of fuel injectors 166 and 170 may be configured as direct fuel injectors for injecting fuel directly into cylinder 14. In another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. In still another example, cylinder 14 may be fueled solely by fuel injector 166, or solely by direct injection. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

Figure 2:
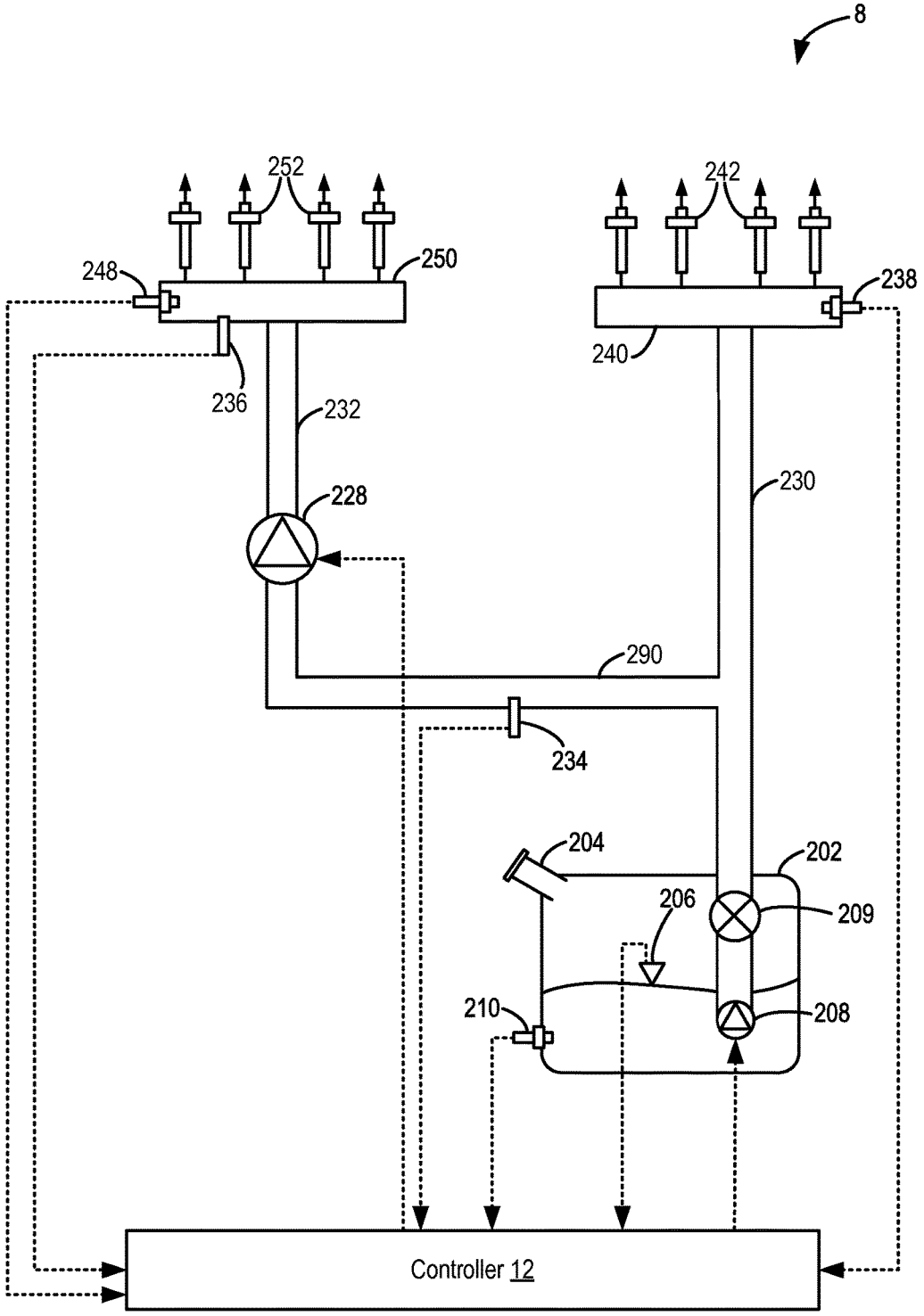
FIG. 2 schematically illustrates an example embodiment of a fuel system that may be used in the engine of FIG. 1.

FIG. 2 schematically depicts an example fuel system 8 of FIG. 1. Fuel system 8 may be operated to deliver fuel from a fuel tank 202 to direct fuel injectors 252 and port injectors 242 of an engine, such as engine 10 of FIG. 1. Fuel system 8 may be operated by a controller, such as controller 12 of FIG. 1, to perform some or all of the operations described with reference to the example routines depicted in FIGS. 4 and 5.

Fuel system 8 can provide fuel to an engine, such as example engine 10 of FIG. 1, from a fuel tank 202. By way of example, the fuel may include one or more hydrocarbon components, and may also include an alcohol component. Under some conditions, this alcohol component can provide knock suppression to the engine when delivered in a suitable amount, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g., methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost. As a specific non-limiting example, fuel may include gasoline and ethanol, (e.g., E10, and/or E85). Fuel may be provided to fuel tank 202 via fuel filling passage 204.

A low pressure fuel pump 208 (herein, also termed lift pump 208) in communication with fuel tank 202 may be operated to supply fuel from fuel tank 202 to a first group of port injectors 242, via a first fuel passage 230. Lift pump 208 may also be referred to as LPP 208, or a LP (low pressure) pump 208. In one example, LPP 208 may be an electrically-powered lower pressure fuel pump disposed at least partially within fuel tank 202. Fuel lifted by LPP 208 may be supplied at a lower pressure into a first fuel rail 240 coupled to one or more fuel injectors of first group of port injectors 242 (herein also referred to as first injector group). An LPP check valve 209 may be positioned at an outlet of the LPP. LPP check valve 209 may direct fuel flow from LPP 208 to first fuel passage 230 and second fuel passage 290, and may block fuel flow from first and second fuel passages 230 and 290 respectively back to LPP 208.

While first fuel rail 240 is shown dispensing fuel to four fuel injectors of first group of port injectors 242, it will be appreciated that first fuel rail 240 may dispense fuel to any suitable number of fuel injectors. As one example, first fuel rail 240 may dispense fuel to one fuel injector of first group of port injectors 242 for each cylinder of the engine. Note that in other examples, first fuel passage 230 may provide fuel to the fuel injectors of first group of port injectors 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 (or DI pump 228 or high pressure pump 228) is included in second fuel passage 232 and may receive fuel via LPP 208. In one example, direct injection fuel pump 228 may be a mechanically-powered positive-displacement pump. Direct injection fuel pump 228 may be in communication with a group of direct fuel injectors 252 via a second fuel rail 250. Second fuel rail 250 may be a high (or higher) pressure fuel rail. Second fuel rail 250 may also be termed direct injection (DI) fuel rail 250. Direct injection fuel pump 228 may further be in fluidic communication with first fuel passage 230 via second fuel passage 290. Thus, fuel at lower pressure lifted by LPP 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in fuel tank 202 via fuel level sensor 206. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel tank 202 may be provided by fuel composition sensor 210. Fuel composition sensor 210 may further comprise a fuel temperature sensor. Additionally or alternatively, one or more fuel composition sensors may be provided at any suitable location along the fuel passages between the fuel storage tank and the two fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, fuel composition sensors 238 and 248, arranged at the fuel rails or along the fuel passages coupling the fuel injectors with fuel tank 202, can provide an indication of a fuel composition before being delivered to the engine. In contrast, fuel composition sensor 210 may provide an indication of the fuel composition at the fuel tank 202.

Fuel system 8 may also comprise pressure sensor 234 coupled to second fuel passage 290, and pressure sensor 236 coupled to second fuel rail 250. Pressure sensor 234 may be used to determine a fuel line pressure of second fuel passage 290 which may correspond to a delivery pressure of low pressure pump 208. Pressure sensor 236 may be positioned downstream of DI fuel pump 228 in second fuel rail 250 and may be used to measure fuel rail pressure (FRP) in second fuel rail 250. Additional pressure sensors may be positioned in fuel system 8 such as at the first fuel rail 240 to measure the pressure therein. Sensed pressures at different locations in fuel system 8 may be communicated to controller 12.

LPP 208 may be used for supplying fuel to both the first fuel rail 240 during port fuel injection and the DI fuel pump 228 during direct injection of fuel. During both port fuel injection and direct injection of fuel, LPP 208 may be controlled by controller 12 to supply fuel to the first fuel rail 240 and/or the DI fuel pump 228 based on fuel rail pressure in each of first fuel rail 240 and second fuel rail 250.

In one example, during port fuel injection, controller 12 may control LPP 208 to operate in a continuous mode to supply fuel at a constant fuel pressure to first fuel rail 240 so as to maintain a relatively constant port fuel injection pressure.

On the other hand, during direct injection of fuel when port fuel injection is OFF and deactivated, controller 12 may control LPP 208 to supply fuel to the DI fuel pump 228. LPP 208 may be operated in a pulsed mode, where the LPP is alternately switched ON and OFF based on fuel pressure readings from pressure sensor 236 coupled to second fuel rail 250. In an alternate embodiment, LPP 208 may be operated in pulsed mode during both PFI and DI engine operations to benefit from reduced power consumption of the lift pump when operated in the pulsed mode.

As such, LPP 208 and the DI fuel pump 228 may be operated to maintain a prescribed fuel rail pressure in second fuel rail 250. Pressure sensor 236 coupled to the second fuel rail 250 may be configured to provide an estimate of the fuel pressure available at the group of direct injectors 252. Then, based on a difference between the estimated rail pressure and a desired rail pressure, each of the pump outputs may be adjusted.

Controller 12 can also control the operation of each of fuel pumps LPP 208 and DI fuel pump 228 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. As one example, a DI fuel pump duty cycle may refer to a fractional amount of a full DI fuel pump volume to be pumped. Thus, a 10% DI fuel pump duty cycle may represent energizing a solenoid activated check valve such that 10% of the DI fuel pump volume may be pumped. A driver (not shown) electronically coupled to controller 12 may be used to send a control signal to LPP 208, as required, to adjust the output (e.g., speed, delivery pressure) of the LPP 208. The amount of fuel that is delivered to the group of direct injectors via the DI fuel pump 228 may be adjusted by adjusting and coordinating the output of the LPP 208 and the DI fuel pump 228.

Figure 3:
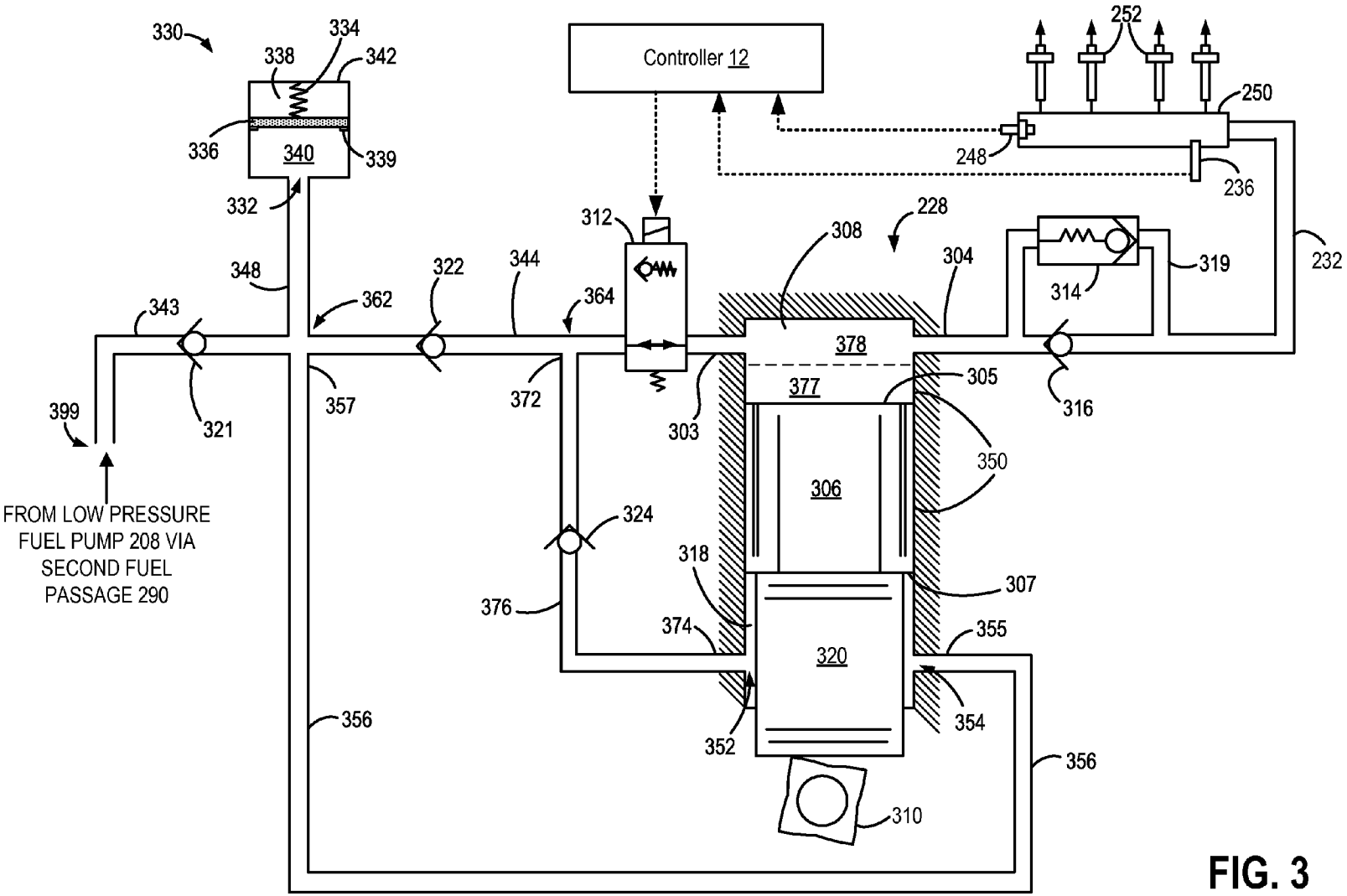
FIG. 3 presents an example embodiment of a high pressure pump in accordance with the present disclosure.

FIG. 3 illustrates example DI fuel pump 228 (also termed, DI pump 228) shown in the fuel system 8 of FIG. 2. As mentioned earlier in reference to FIG. 2, DI pump 228 receives fuel at a lower pressure from LPP 208 via second fuel passage 290. Further, DI pump 228 pressurizes the fuel to a higher pressure before pumping the fuel to second group of injectors 252 (or direct injectors) via second fuel passage 232. Inlet 303 of compression chamber 308 in DI pump 228 is supplied fuel via low pressure fuel pump 208 as shown in FIG. 3. The fuel may be pressurized upon its passage through direct injection fuel pump 228 and may be supplied to second fuel rail 250 and direct injectors 252 through pump outlet 304.

In the depicted example, direct injection pump 228 may be an engine driven displacement pump that includes a pump piston 306 and piston rod 320 (also termed, piston stem 320), a pump compression chamber 308 (herein also referred to as compression chamber), bore 350, and a step room 318. Pump piston 306 may move axially (e.g., in a reciprocating motion) within bore 350. Assuming that pump piston 306 is substantially at a bottom dead center (BDC) position in FIG. 3, the pump displacement may be represented as displacement volume 377. The displacement of the DI pump may be measured as the area swept by pump piston 306 as it moves from top dead center (TDC) to BDC or vice versa. A second volume also exists within compression chamber 308, the second volume being a clearance volume 378 of the pump. Clearance volume 378 of the pump may also be known as dead volume 378. The clearance volume defines the region in compression chamber 308 that remains when pump piston 306 is at TDC. In other words, the addition of displacement volume 377 and clearance volume 378 form compression chamber 308.

Pump piston 306 includes a piston top 305 and a piston bottom 307. Pump piston 306 may be coupled (e.g., mechanically) to piston rod 320. In the example embodiment of FIG. 3, piston rod 320 may have an external diameter that is substantially the same as an external diameter of pump piston 306. By enlarging a width of the piston rod 320 to substantially the same as a width of pump piston 306, pump reflux from step room 318 may be reduced.

Reflux may occur in piston-operated pumps (e.g., a DI pump with pump piston coupled to a piston stem that is narrower relative to an external diameter of the pump piston) wherein a portion of the pumped liquid (fuel in this case) is repeatedly forced into and out of the step room into a low pressure fuel line. The progression of pump reflux may be described as follows: during the compression stroke in the DI fuel pump, as the pump piston is traveling from bottom dead center (BDC) to top dead center (TDC), fluid may be sucked from low pressure fuel line (e.g., fuel supply line 344) to the step room or volume under the piston. During the pump's suction (intake) stroke, as the pump piston is traveling from TDC to BDC, fluid may be forced from the bottom of the piston (the volume under the piston, step room) toward the low pressure fuel supply line.

Pump reflux may excite the natural frequency of the low pressure fuel supply line. The repeated, reversing fuel flow from the bottom of the piston may create fuel pressure and flow pulsations that may at least partially cause a number of issues. One of these issues may be increased noise caused by the flow pulsations, thereby requiring additional sound reduction components that may otherwise be unnecessary.

Pump reflux from the step room may be reduced by incorporating a wider piston rod (e.g., piston rod with a larger diameter) in the DI fuel pump. As shown in FIG. 3, DI fuel pump 228 includes piston rod 320 with an outside diameter that is equal or substantially equal to the outside diameter of pump piston 306. To easily differentiate between the stem and piston in FIG. 3, the diameter of piston stem 320 is shown to be slightly smaller than the diameter of pump piston 306, when in reality the diameters may be equal.

Thus, step room 318 may be occupied largely by piston stem 320, thereby significantly reducing the variable volume of step room 318 on the backside of pump piston 306. In other words, a smaller vacuous volume is present on the backside of pump piston 306 in between the bore and the piston stem (e.g., within the step room) throughout the movement of the pump piston. In this way, as pump piston 306 and the piston stem 320 move from TDC to BDC and vice versa, pump reflux on the underside of pump piston 306 (e.g., from step room 318) may be significantly reduced.

In an alternative embodiment, the piston stem 320 may have an exterior diameter that is approximately half (e.g. 50%) the exterior diameter of pump piston 306 to reduce pump reflux from the step room 318.

The step room 318 and compression chamber 308 may include respective cavities positioned on opposing sides of the pump piston 306. To elaborate, step room 318 may be a variable volume region formed underneath piston bottom 307 (as depicted in FIG. 3). Further, compression chamber 308 may be a chamber of variable volume formed above piston top 305 of pump piston 306 (as shown in FIG. 3). Other example positions of the step room and compression chamber are possible relative to pump piston 306 without departing from the scope of this disclosure. Step room 318 may surround piston stem 320. It will also be noted that step room 318 is largely consumed by piston stem 320.

In one example, driving cam 310 may be in contact with piston rod 320 of the DI pump 228 and may be configured to drive pump piston 306 from BDC to TDC and vice versa, thereby creating the motion necessary to pump fuel through compression chamber 308. Driving cam 310 includes four lobes and completes one rotation for every two engine crankshaft rotations. A cam follower, e.g., a roller-follower, may be positioned between the piston stem 320 and driving cam 310.

Pump piston 306 reciprocates up and down within bore 350 of DI fuel pump 228 to pump fuel. DI fuel pump 228 is in a compression stroke when pump piston 306 is traveling in a direction that reduces the volume of compression chamber 308. Conversely, direct fuel injection pump 228 is in a suction stroke or an intake stroke when pump piston 306 is traveling in a direction that increases the volume of compression chamber 308.

A solenoid activated check valve (SACV) 312 is positioned upstream of inlet 303 to compression chamber 308 of DI pump 228. SACV 312 may also be termed spill valve 312. Controller 12 may be configured to regulate fuel flow through solenoid activated check valve 312 by energizing or de-energizing a solenoid within SACV 312 (based on the solenoid valve configuration) in synchronism with the driving cam 310. Accordingly, SACV 312 may be operated in two distinct, albeit, potentially overlapping, modes. In a first mode (e.g., a variable pressure mode), SACV 312 is actuated to limit (e.g., inhibit) the amount of fuel traveling through the SACV to upstream of the SACV 312. To elaborate, the SACV may obstruct fuel flow from compression chamber 308 through SACV 312 to upstream of SACV 312. In the first mode, fuel may flow through SACV 312 from upstream of SACV 312 to downstream of SACV 312. In a second mode (e.g., a default pressure mode), SACV 312 is effectively disabled and fuel can travel through SACV 312 both upstream and downstream of SACV 312. While SACV 312 has been described as above, it also can be implemented as a solenoid plunger that forces a check valve open when de-energized. This plunger design may have an additional advantage of being able to de-energize the solenoid once pressure builds in the compression chamber 308, thus holding the check valve closed.

As mentioned earlier, SACV 312 may be configured to regulate the mass (or volume) of fuel compressed within DI fuel pump 228. In one example, controller 12 may adjust a closing timing of the SACV to regulate the mass of fuel compressed. For example, closing the SACV 312 at a later time relative to piston compression (e.g., as volume of compression chamber is decreasing) may reduce the amount of fuel mass delivered from the compression chamber 308 to pump outlet 304 since more of the fuel displaced from the compression chamber 308 can flow through the SACV 312 before it closes. Herein, the SACV may be in a pass-through state allowing fuel to flow from compression chamber 308 through SACV 312 to upstream of SACV 312, until the SACV 312 is closed. For example, a 30% duty cycle operation of the DI pump may include closing the SACV 312 when the compression stroke is about 70% complete (e.g., a later closing). In other words, the 30% duty cycle operation may include closing the SACV 312 when 70% of the fuel in the compression chamber is expelled through the SACV 312 and 30% fuel is retained in the compression chamber. Thus, the 30% duty cycle operation delivers about 30% of the DI fuel pump volume into the DI fuel rail 250.

In contrast, an early closing of the solenoid activated inlet check valve relative to piston compression (e.g., as volume of compression chamber is decreasing) may increase the amount of fuel mass delivered from the compression chamber 308 to the pump outlet 304 since less of the fuel displaced from the compression chamber 308 can flow (in reverse direction) through the electronically controlled check valve 312 before it closes. An example of early closing of the SACV may occur during an 80% duty cycle operation of the DI fuel pump. Herein the SACV 312 may be closed early in the compression stroke, e.g., when 20% of the compression stroke is complete. To elaborate, the 80% duty cycle operation of the DI pump may include closing the SACV 312 when about 20% of the DI fuel pump volume is expelled from the compression chamber through the SACV 312. Thus, 80% of the DI fuel pump volume may be delivered to the DI fuel rail 250 via pump outlet 304.

Opening and closing timings of the SACV 312 may be coordinated with stroke timings of the DI fuel pump 228. Alternately or additionally, by continuously throttling fuel flow into the DI fuel pump from the low pressure fuel pump, fuel ingested into the direct injection fuel pump may be regulated without use of SACV 312.

Pump inlet 399 may receive fuel from an outlet of LPP 208 via second fuel passage 290 and may direct the fuel along first section 343 of fuel supply line 344 to SACV 312 via third check valve 321 and first check valve 322. First section 343 of fuel supply line 344 extends from pump inlet 399 until node 362. Further, third check valve 321 is coupled to first section 343 of fuel supply line 344 downstream of pump inlet 399 and upstream of node 362. As such, node 362 includes a node where accumulator 330 is fluidically coupled to fuel supply line 344. Third check valve 321 enables fuel to flow from pump inlet 399 towards node 362 and SACV 312 along fuel supply line 344. Further, third check valve 321 obstructs the flow of fuel from node 362 towards pump inlet 399 and LPP 208.

First check valve 322 is positioned upstream of SACV 312 along fuel supply line 344. First check valve 322 is biased to impede fuel flow out of SACV 312 towards accumulator 330, third check valve 321, and pump inlet 399. First check valve 322 allows fuel flow from the low pressure pump 208 to SACV 312. Further still, first check valve allows fuel flow from accumulator 330 to SACV 312. Accumulator 330 may store fuel during at least a portion of a compression stroke in the DI fuel pump 228 and may release the stored fuel during at least a portion of an intake stroke in the DI fuel pump 228.

When solenoid activated check valve 312 is deactivated (e.g., not electrically energized), and DI fuel pump 228 is operating in the second mode (such as the default pressure mode), solenoid activated check valve 312 operates in a pass-through state allowing fuel to flow through SACV 312 both upstream and downstream of SACV 312. Further, pressure in the DI fuel pump 228 may be maintained at a default pressure via accumulator 330. Accumulator 330 is a pressure accumulator positioned along fuel supply line 344 upstream of each of first check valve 322 and SACV 312 and downstream of third check valve 321. As depicted, first check valve is arranged between accumulator 330 and SACV 312 while third check valve 321 is positioned between pump inlet 399 and accumulator 330. In one example, accumulator 330 is a 15 bar (absolute) accumulator. In another example, accumulator 330 is a 20 bar (absolute) accumulator. As such, accumulator 330 may be a pre-loaded accumulator.

The default pressure in DI fuel pump 228 in the default pressure mode may be based on a pressure rating of accumulator 330. Specifically, the default pressure may be based on a force constant of a spring 334 coupled to a piston 336 within accumulator 330. As depicted in FIG. 3, accumulator 330 includes a first variable volume 340 formed underneath piston 336 and a second variable volume 338 formed above piston 336. Piston 336 may move axially between lower stop 339 and roof 342 of accumulator 330 as a fluid is stored in and released from first variable volume 340. The fluid, such as fuel, may enter accumulator 330 via entrance 332 and may be stored in first variable volume 340. Second variable volume 338 may be formed around spring 334 towards an upper portion of accumulator 330. It will be noted that though accumulator 330 is shown as a spring-piston type pressure accumulator, other types of pressure accumulators known in the art may be used without departing from the scope of this disclosure.

Accumulator 330 may also apply a positive pressure across the pump piston 306 during a portion of the piston intake (suction) stroke, further enhancing Poiseuille lubrication. In addition, a portion of compression energy from the positive pressure applied by accumulator 330 on pump piston 306 may be transferred to a camshaft of driving cam 310.

Regulating the pressure in compression chamber 308 allows a pressure differential to form from piston top 305 to piston bottom 307. The pressure in step room 318 may be at the pressure of the outlet of the low pressure pump (e.g., 5 bar) during at least a portion of a pump stroke while the pressure at piston top 305 is at a regulation pressure of accumulator 330 (e.g., 15 bar). The pressure differential allows fuel to seep from piston top 305 to piston bottom 307 through a clearance between pump piston 306 and bore 350, thereby lubricating direct injection fuel pump 228.

During conditions when DI fuel pump operation is regulated mechanically, controller 12 may deactivate solenoid activated inlet check valve 312 and accumulator 330 regulates pressure in fuel rail 250 (and compression chamber 308) to a single substantially constant (e.g., accumulator pressure±0.5 bar) pressure during most of the compression stroke. On the intake stroke of pump piston 306, the pressure in compression chamber 308 drops to a pressure near the pressure of the lift pump 208. One result of this regulation method is that the fuel rail is regulated to a minimum pressure approximately the pressure of accumulator 330. Thus, if accumulator 330 has a pressure setting of 15 bar, the fuel rail pressure in second fuel rail 250 becomes 20 bar because the accumulator pressure setting of 15 bar is added to the 5 bar of lift pump pressure. Specifically, the fuel pressure in compression chamber 308 is regulated during the compression stroke of direct injection fuel pump 228. It will be appreciated that the solenoid activated check valve 312 is maintained deactivated (in pass-through state) throughout the operation of the DI fuel pump 228 in the default pressure mode.

A forward flow outlet check valve 316 (also termed, outlet check valve 316) may be coupled downstream of pump outlet 304 of the compression chamber 308 of DI fuel pump 228. Outlet check valve 316 opens to allow fuel to flow from the pump outlet 304 of compression chamber 308 into second fuel rail 250 only when a pressure at the pump outlet 304 of direct injection fuel pump 228 (e.g., a compression chamber outlet pressure) is higher than the fuel rail pressure. In another example DI fuel pump, inlet 303 to compression chamber 308 and pump outlet 304 may be the same port.

A fuel rail pressure relief valve 314 is located parallel to outlet check valve 316 in a parallel passage 319 that branches off from second fuel passage 232. Fuel rail pressure relief valve 314 may allow fuel flow out of fuel rail 250 and passage 232 into compression chamber 308 when pressure in parallel passage 319 and second fuel passage 232 exceeds a predetermined pressure, where the predetermined pressure may be a relief pressure setting of fuel rail pressure relief valve 314. As such, fuel rail pressure relief valve 314 may regulate pressure in fuel rail 250. Fuel rail pressure relief valve 314 may be set at a relatively high relief pressure such that it acts only as a safety valve that does not affect normal pump and direct injection operation.

During operation in either mode (variable pressure or default pressure), DI fuel pump 228 may form a hot spot on piston bottom 307 of pump piston 306. Accordingly, temperature of fuel within step room 318 may increase resulting in vaporization of fuel and leading to other adverse effects of fuel vaporization. Fuel in the step room 318 along with the piston bottom 307 may be cooled by circulating cooler fuel through step room 318. For example, a portion of fuel from the compression chamber 308 may be directed to step room 318 to replace fuel in step room 318 and enable cooling of the piston bottom 307.

Accordingly, the example embodiment of DI fuel pump 228 in FIG. 3 includes first fuel conduit 376 fluidically communicating with fuel supply line 344. To elaborate, a first end 372 of first fuel conduit 376 is fluidically coupled to fuel supply line 344 at node 364 wherein node 364 is positioned downstream of first check valve 322 and upstream of SACV 312 relative to fuel flow during an intake stroke in DI pump 228. As such, first end 372 of first fuel conduit 376 is coupled to fuel supply line 344 between first check valve 322 and SACV 312. First fuel conduit 376 includes second check valve 324 which allows fuel flow from fuel supply line 344 (e.g., from node 364) towards an inlet 352 of step room 318. Thus, second check valve 324 obstructs fuel flow from step room 318 to fuel supply line 344 (e.g., to node 364) via first fuel conduit 376. Further, first fuel conduit 376 is fluidically coupled to inlet 352 of step room 318 via second end 374 of first fuel conduit 376.

When SACV 312 is in the pass-through state, and pump piston 306 is in a compression stroke, a portion of fuel within compression chamber 308 may be ejected via inlet 303 of compression chamber 308, through SACV 312 towards first check valve 322 along fuel supply line 344. Since first check valve 322 impedes fuel flow from SACV 312 towards accumulator 330 along fuel supply line 344, the portion of fuel exiting compression chamber 308 may stream via node 364 into first end 372 of first fuel conduit 376, and through first fuel conduit 376 and second check valve 324 into step room 318. The portion of fuel may be received via second end 374 of first fuel conduit 376 into inlet 352 of step room 318. The portion of fuel exiting compression chamber 308 during the compression stroke through SACV 312 may be termed reflux fuel.

An outlet 354 of step room 318 may be fluidically coupled to fuel supply line 344 at node 362 via second fuel conduit 356. To elaborate, second fuel conduit 356 may be fluidically coupled to fuel supply line 344 (or first section 343 of fuel supply line 344) downstream of third check valve 321 at node 362. Fuel from step room 318 including the portion of fuel (e.g., reflux fuel) may exit step room 318 via outlet 354 of step room 318. Further, the portion of fuel may flow into first end 355 of second fuel conduit 356, stream through second fuel conduit 356, and flow towards accumulator 330 which may be coupled to fuel supply line 344 at node 362. It will be noted that accumulator 330 is fluidically coupled to fuel supply line 344 at node 362 via passage 348. Thus, node 362 may include a fluidic coupling between a second end 357 of second fuel conduit 356, accumulator 330 (via passage 348), first section 343 of fuel supply line 344, and fuel supply line 344. Further still, second end 357 of second fuel conduit 356 intersects fuel supply line 344 at node 362 positioned upstream of first check valve 322 and downstream of third check valve 321 relative to fuel flow from pump inlet 399 towards SACV 312.

Thus, the portion of fuel (also termed, reflux fuel) may exit step room 318 and be returned to each of accumulator 330 and fuel supply line 344 via second fuel conduit 356. As such, the portion of fuel may be largely stored within accumulator 330 (e.g., in first variable volume 340) during the remaining duration of the compression stroke. Third check valve 321 may block the flow of fuel towards pump inlet 399. Accordingly, a larger proportion of the reflux fuel may be directed towards accumulator 330 via passage 348.

In this way, fuel may be positively pumped through step room 318 using reflux fuel flow from compression chamber 308. Specifically, reflux fuel from piston top 305 of pump piston 306 is used for circulation and cooling of step room 318. Reflux fuel from the compression chamber 308 may be suited for a DI fuel pump which includes a pump piston 306 coupled to a piston stem 320 with an exterior diameter that is substantially the same as the exterior diameter of the pump piston 306.

It will be appreciated that though the depicted example of FIG. 3 shows second check valve 324 coupled to first fuel conduit 376, in alternate embodiments, second check valve 324 may be instead positioned in second fuel conduit 356 between outlet 354 of step room 318 and second end 357 of second fuel conduit 356. Thus, an example system may comprise an engine, a lift pump, a direct injection fuel pump including a piston coupled to a piston stem, a compression chamber, a step room, and a cam for driving the piston, a high pressure fuel rail fluidically coupled to an outlet of the direct injection fuel pump, a solenoid activated check valve positioned at an inlet of the direct injection fuel pump, a fuel supply line fluidically coupling the lift pump and the solenoid activated check valve, an accumulator positioned upstream of the solenoid activated check valve, the accumulator fluidically communicating with the fuel supply line, a first check valve coupled to the fuel supply line between the accumulator and the solenoid activated check valve, a first fuel conduit including a second check valve, a first end of the first fuel conduit fluidically coupled to the fuel supply line between the first check valve and the solenoid activated check valve, a second end of the first fuel conduit fluidically coupled to an inlet of the step room, a second fuel conduit, a first end of the second fuel conduit fluidically coupled to an outlet of the step room, and a second end of the second fuel conduit fluidically coupled to the fuel supply line at the accumulator upstream of the first check valve and downstream of a third check valve. The system may further comprise a controller having executable instructions stored in a non-transitory memory for de-energizing the solenoid activated check valve to function in a pass-through state. The solenoid activated check valve may be de-energized and may function in the pass-through state for an entire pump stroke during a default pressure mode of operation of the direct injection fuel pump. Further, the solenoid activated check valve may be de-energized and may also function in the pass-through state during a portion of the pump stroke (e.g., an earlier part of the compression stroke) in variable pressure mode operation of the direct injection fuel pump (e.g., when duty cycle is <100%). During a portion of a compression stroke in the direct injection fuel pump, reflux fuel from the compression chamber may flow to the step room via the solenoid activated check valve in the pass-through state, into the first end (e.g., 372) of the first fuel conduit (e.g., 376), through the second check valve 324, and via the second end (e.g. 374) of the first fuel conduit 376 into the inlet 352 of the step room 318. The reflux fuel may further stream from the outlet 354 of the step room 318 into the first end (e.g., 355) of the second fuel conduit 356 towards the accumulator 330 and the fuel supply line 344 via the second end 357 of the second fuel conduit 356.

It will be appreciated that though the example embodiment shown in FIGS. 2 and 3 includes a port fuel direct injection engine, the direct injection fuel pump of the present disclosure may also be suitable for a direct injection engine.

It will be noted that while DI pump 228 is shown in FIG. 2 as a symbol with no detail, FIG. 3 shows pump 228 in full detail. It will also be noted that each of first fuel conduit 376 and second fuel conduit 356 may not include any additional intervening components (e.g., valves, additional passages, etc.) than those described and depicted in FIG. 3. Thus, first fuel conduit 376 fluidically couples step room 318 to fuel supply line 344 and may include only second check valve 324 coupled to first fuel conduit 376. No other component or opening may be included in first fuel conduit 376 between node 364 and inlet 352 of step room 318. Second fuel conduit 356 fluidically couples outlet 354 of step room 318 to each of fuel supply line 344 and accumulator 330 without any intervening elements or openings within the second fuel conduit 356. In alternate embodiments, second check valve 324 may be positioned in second fuel conduit 356. Further, first section 343 of fuel supply line 344 may include third check valve 321 alone without additional components, valves, channels, etc. than that depicted in FIG. 3. Further still, no intervening components, passages, or openings than those described (and depicted in FIG. 3) may be included in first section 343 of fuel supply line 344 between pump inlet 399 and node 362 (other than third check valve 321). Additionally, no intervening components, passages, or openings than those described (and depicted in FIG. 3) may be included in fuel supply line 344 between node 362 and first check valve 322, and between first check valve 322 and SACV 312. Thus, first fuel conduit 376 may be the only channel fluidically coupled between first check valve 322 and SACV 312. Passage 348 may fluidically couple accumulator 330 to fuel supply line 344 at node 362 and second fuel conduit 356 may be fluidically coupled to fuel supply line 344 (and to accumulator 330) at node 362. Thus, passage 348 and second fuel conduit 356 may be the only channels coupled to fuel supply line 344 between DI pump inlet 399 and first check valve 322.

It is further noted here that DI pump 228 of FIG. 3 is presented as an illustrative example of one possible configuration for a DI pump that can be operated in an electronic regulation (or variable pressure) mode as well as in a default pressure or mechanically-regulated mode. Components shown in FIG. 3 may be removed and/or changed while additional components not presently shown may be added to DI fuel pump 228 while still maintaining the ability to deliver high-pressure fuel to a direct injection fuel rail with and without electronic pressure regulation.

Figure 4:
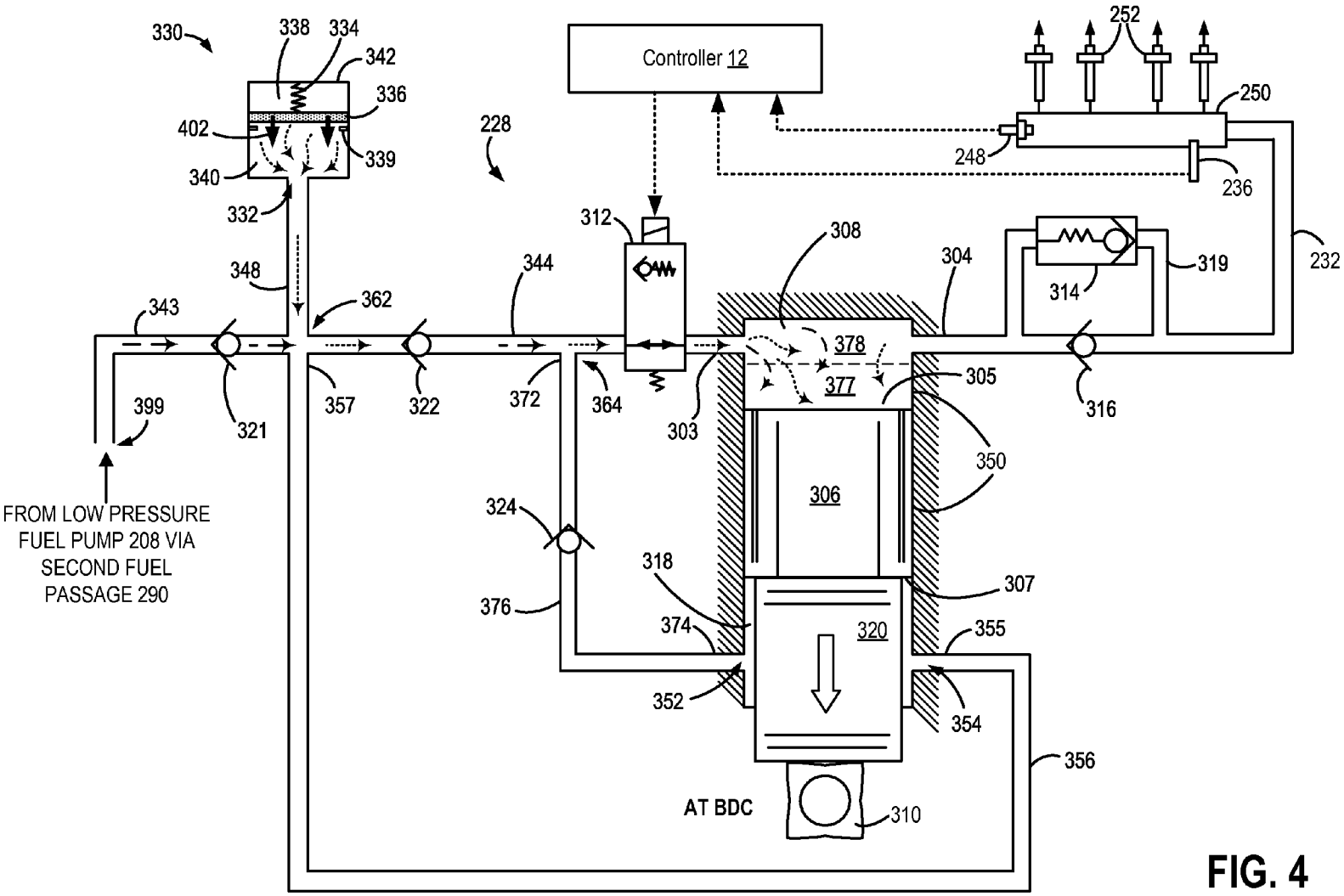
FIG. 4 demonstrates an example fuel flow during a suction stroke in the high pressure pump of FIG. 3.

Turning now to FIG. 4, it shows an example flow of fuel during an intake stroke (also termed, suction stroke) in DI fuel pump 228. Fuel flow from the accumulator (e.g., stored reflux fuel) is depicted as dashed lines (short dashes) and fuel received from the LP pump is depicted as lines with longer dashes. The direction of fuel flow is indicated by the arrows on the dashed lines.

As shown in FIG. 4, pump piston 306 (and piston stem 320) travels downwards in the suction stroke towards bottom dead center (BDC) position such that the volume of compression chamber 308 increases. Further still, pump piston 306 along with piston stem 320 may move (concurrently) away from compression chamber 308 when in the intake stroke. The moment depicted in FIG. 4 may indicate a moment immediately before pump piston 306 reaches BDC position.

As the volume of compression chamber 308 increases, fuel may be drawn into the compression chamber from each of the accumulator 330 (short dashed lines) and LPP 208 (longer dashes) via first check valve 322 and through SACV 312. As depicted, controller 12 may command SACV 312 to the pass-through state during the suction stroke enabling fuel to flow into the compression chamber 308. Fuel stored in first variable volume 340 of accumulator 330 may be drawn towards entrance 332 of accumulator 330 in the suction stroke. Further, as the stored fuel exits accumulator 330 via passage 348, piston 336 of the accumulator may shift downwards towards lower stop 339 (as shown by bold arrows 402). Stored fuel from the accumulator 330 may be released first into fuel supply line 344 (and compression chamber 308) prior to drawing additional fuel from LPP 208. Alternatively, fuel may be drawn simultaneously (as shown in FIG. 4) from each of LPP 208 and accumulator 330 into compression chamber 308.

Figure 5:
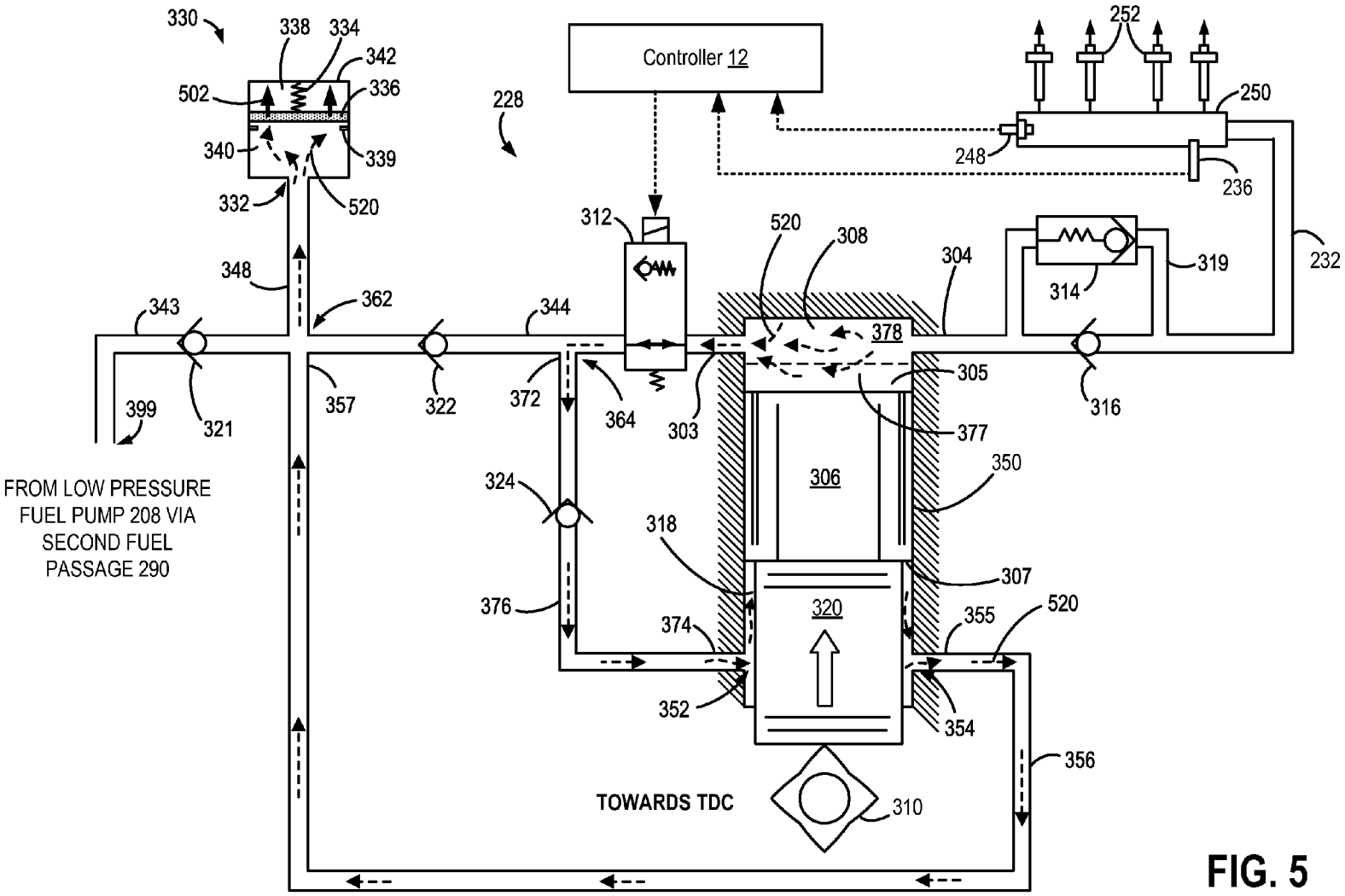
FIG. 5 depicts an example fuel flow during a compression stroke in the high pressure pump of FIG. 3.

Thus, fuel may flow from LPP 208 (via pump inlet 399 through first section 343 of fuel supply line 344 past third check valve 321,) and accumulator 330 (via entrance 332 and passage 348 of accumulator 330) across node 362, into fuel supply line 344 and past first check valve 322, via node 364, through SACV 312 into inlet 303 of compression chamber 308. Further, in the suction stroke there may be no net fuel flow into first fuel conduit 376. There may be no net fuel flow out of step room 318 into second fuel conduit 356 during the suction stroke as the piston rod 320 is substantially the same diameter as the pump piston 306. FIG. 5 presents an example flow of fuel during a compression stroke in the DI fuel pump 228. The depicted compression stroke in DI fuel pump 228 may be a compression stroke subsequent to the suction stroke shown in FIG. 4. Further still, the SACV 312 continues to be open and in its pass-through state, allowing fuel to flow from compression chamber 308 to upstream of SACV 312. Herein, the SACV 312 may be held in its pass-through state during either an initial duration of the compression stroke based on a desired duty cycle, specifically a less than 100% duty cycle, of the DI pump in the variable pressure mode. Alternatively, the SACV 312 may be held in its pass-through state for an entire pump stroke during the default pressure mode of DI pump operation.

It will be appreciated that if a 100% duty cycle of pump operation is commanded, SACV 312 may be energized to close at the initiation of the compression stroke, and there may be no reflux fuel exiting the SACV 312 during the compression stroke.

During the compression stroke (also termed, delivery stroke), pump piston 306 moves towards top dead center (TDC) position such that the volume of the compression chamber 308 reduces. Accordingly, fuel in the compression chamber 308 may be expelled from compression chamber 308 through SACV 312 towards node 364 in fuel supply line 344. Since first check valve 322 impedes the flow of fuel from SACV 312 (or node 364) towards either accumulator 330 or node 362, fuel may stream into first end 372 of first fuel conduit 376 at node 364. Fuel expelled from compression chamber 308 through SACV 312 during the compression stroke, termed reflux fuel 520, is depicted as dashed lines (medium dashes relative to large and small dashes of fuel flow in FIG. 4). Reflux fuel 520 may flow from compression chamber 308, through SACV 312, past node 364, into first end 372 of first fuel conduit 376 and through first fuel conduit 376, across second check valve 324, past second end 374 of first fuel conduit 376, and into step room 318 via inlet 352 of step room 318. The direction of reflux fuel flow when the SACV 312 is in pass-through state is indicated by arrows on the dashed lines representing reflux fuel 520. All fuel flow depicted in FIG. 5 is for reflux fuel flow.

Reflux fuel may enter step room 318 via inlet 352 and may exit step room 318 via outlet 354 of step room 318. Outlet 354 of step room 318, in the depicted example, is positioned opposite from inlet 352 of step room 318. In alternative examples, the outlet 354 of step room 318 may be positioned at a different location than shown in FIG. 5 relative to inlet 352 of step room 318 without departing from the scope of this disclosure.

Since piston stem 320 occupies a considerable vacuous volume of step room 318, reflux fuel 520 from compression chamber 308 arriving in step room 318 may also exit step room 318 during the compression stroke. Thus, reflux fuel 520 is shown exiting step room 318 via outlet 354 into second fuel conduit 356. To elaborate, reflux fuel 520 may stream into second fuel conduit 356 via first end 355 of the second fuel conduit 356. Further, reflux fuel 520 may flow through second fuel conduit 356 to be returned to the fuel supply line 344 via second end 357 of second fuel conduit 356 at node 362 upstream of first check valve 322. As such, reflux fuel 520 may be returned to fuel supply line 344 at node 362 downstream of third check valve 321. Further still, reflux fuel 520 may flow through passage 348 and enter accumulator 330 since fuel flow to upstream of third check valve 321 towards pump inlet 399 is blocked by third check valve 321. To elaborate, reflux fuel 520 may flow into first variable volume 340 of accumulator 330 via entrance 332. As fuel fills up first variable volume 340, piston 336 of accumulator 330 may shift away from lower stop 339 towards roof 342 (shown by bold arrows 502) of accumulator 330 compressing spring 334 within second variable volume 338. Thus, reflux fuel 520 may be stored in accumulator 330 during at least a part of the compression stroke. The stored reflux fuel 520 may be released into compression chamber 308 during a subsequent intake stroke in the DI fuel pump 228.

Thus, reflux fuel may flow, as shown in FIG. 5, from the compression chamber 308 of DI fuel pump 228 through spill valve 312, past node 364, through first fuel conduit 376, across second check valve 324, into step room 318, and thereon via second fuel conduit 356 into accumulator 330. It will be appreciated that reflux fuel may not flow from the compression chamber 308 into accumulator 330 without first flowing through step room 318 (as first check valve 322 obstructs fuel flow from spill valve 312 towards accumulator 330 and LPP 208).

An example method may, thus, comprise, when a spill valve is in a pass-through state, circulating a portion of fuel from a compression chamber of a direct injection pump to a step room of the direct injection pump, the circulating including flowing the portion of fuel through the spill valve and drawing the portion of fuel into the step room from upstream of the spill valve and downstream of an accumulator. The accumulator (e.g. accumulator 330) may be positioned upstream of the spill valve (e.g., SACV 312), and a first check valve (e.g., first check valve 322) may be positioned between the accumulator and the spill valve. The method may further comprise returning the portion of fuel to a fuel supply line at the accumulator upstream of the first check valve. The drawing of the portion of fuel into the step room from upstream of the spill valve and downstream of an accumulator may include drawing the portion of fuel from upstream of the spill valve and downstream of the first check valve (such as from node 364). The portion of fuel drawn into the step room (e.g. step room 318) from upstream of the spill valve and downstream of the first check valve may flow through a second check valve (such as second check valve 324), the second check valve arranged upstream of the step room. The portion of fuel may include reflux fuel from the compression chamber. Each of the circulating and the returning of the portion of fuel may occur during a compression stroke in the direct injection fuel pump. Further, the portion of fuel may be substantially stored in the accumulator during a period of the compression stroke, and the portion of fuel may be released during a duration of a suction stroke in the pump. In one example, the direct injection fuel pump may include a pump piston coupled to a piston stem, the piston stem having an external diameter that is substantially the same as an external diameter of the pump piston. In another example, the direct injection fuel pump may include a pump piston coupled to a piston stem, the piston stem having an external diameter that is substantially half the size of an external diameter of the pump piston.

Figure 6:
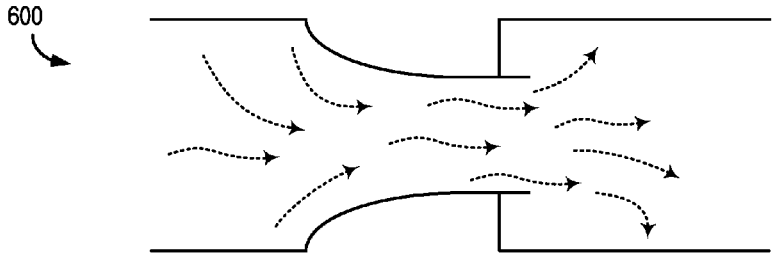
FIG. 6 shows an example bell mouth orifice that may be used in the high pressure pump of FIG. 3.
Figure 7:
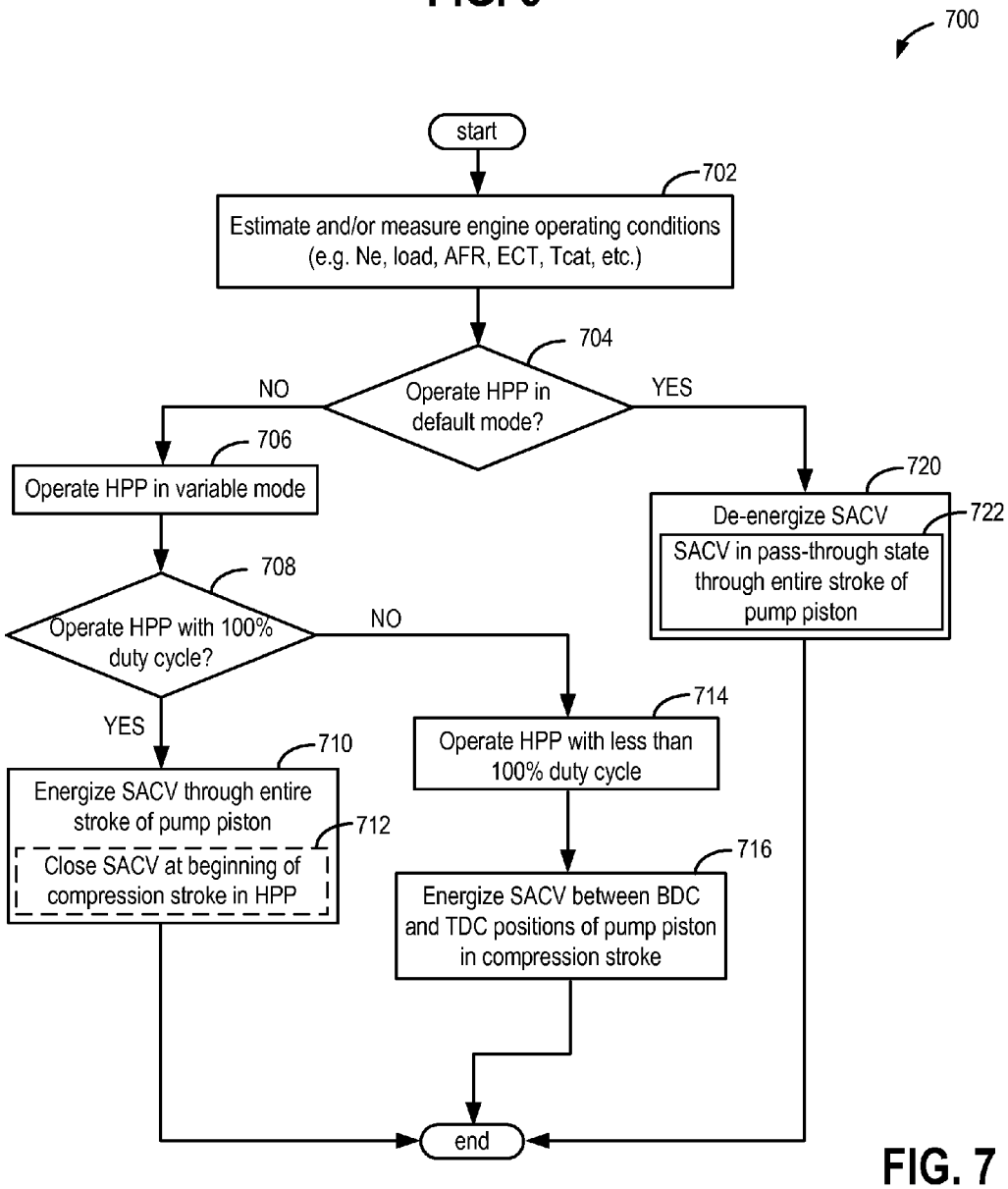
FIG. 7 presents an example flow chart illustrating a control operation of a solenoid activated check valve in the high pressure pump.

Turning now to FIG. 6, it shows an example bell mouth orifice 600 that may be used in the example embodiment of DI fuel pump 228 in FIG. 3 to replace first check valve 322 and second check valve 324. The bell mouth orifice may be designed such that fuel flows more easily in a first direction (e.g., the direction of flow indicated by dashed lines in FIG. 6) than in a second direction. The second direction may be opposite to the first direction. For example, a coefficient of discharge for the bell mouth orifice 600 in the first direction may be 1 while a coefficient of discharge in the second (e.g., opposite to first) direction may be 0.5. By enabling a more rapid fluid flow in the first direction contrary to the second direction, bell mouth orifices may function as check valves enabling fluid flow in the first direction while impeding fluid flow in the second direction. Further, using two smaller bell mouth orifices (e.g., bugle-shaped elements) can provide a greater coefficient of discharge directional difference than one larger bugle.

FIG. 7 presents an example routine 700 illustrating an example control of DI fuel pump operation in the variable pressure mode and in the default pressure mode. Specifically, routine 700 includes activating and energizing a solenoid activated check valve (SACV) at an inlet of the compression chamber of the DI fuel pump when the DI pump is operating in the variable pressure mode. The SACV may be energized to closed dependent on a desired duty cycle of pump operation.

At 702, engine operating conditions may be estimated and/or measured. For example, engine conditions such as engine speed, engine fuel demand, boost, driver demanded torque, engine temperature, air charge, etc. may be determined. At 704, routine 700 may determine if the HPP (e.g., DI fuel pump 228) can be operated in the default pressure mode. The HPP may be operated in default pressure mode, in one example, if the engine is idling. In another example, the HPP may function in default pressure mode if the vehicle is decelerating. If it is determined that the DI fuel pump can be operated in default pressure mode, routine 700 progresses to 720 to deactivate and de-energize the solenoid activated check valve (such as SACV 312 of DI pump 228). To elaborate, the solenoid within the SACV may be de-energized and the SACV may function in a pass-through state at 722 such that fuel may flow through the SACV both upstream from and downstream of SACV. Herein, as explained earlier, a default pressure of DI fuel pump 228 may be achieved by accumulator 330. Routine 700 may then end.

If, however, it is determined at 704 that the HPP may not be operated in default pressure mode, routine 700 continues to 706 to operate the HPP in variable pressure mode. The variable pressure mode of HPP operation may be used during non-idling conditions, in one example. In another example, the variable pressure mode may be used when torque demand is greater, such as during acceleration of a vehicle. As mentioned earlier, variable pressure mode may include controlling HPP operation electronically by actuating and energizing the solenoid activated check valve, and regulating fuel pressure (and volume) via the solenoid activate check valve.

Next, at 708, routine 700 may determine if current torque demand (and fuel demand) includes a demand for full pump strokes. Full pump strokes may include operating the DI fuel pump at 100% duty cycle wherein a substantially large portion of fuel is delivered to the DI fuel rail. An example 100% duty cycle operation of the DI pump may include delivering substantially 100% of the DI fuel pump volume to the DI fuel rail.

If it is confirmed that full pump strokes (e.g., 100% duty cycle) are desired, routine 700 continues to 710, where the SACV may be energized for an entire stroke of the pump. As such, the SACV may be energized (and closed to function as a check valve) through an entire compression stroke. Specifically, at 712, the SACV may be energized and closed at a beginning of a compression stroke. Further, the SACV may be closed at the beginning of each subsequent compression stroke until pump operation is modified. For example, pump operation may be modified when a reduced pump stroke may be commanded or in another example, pump operation may be changed to default pressure mode. Routine 700 may then end.

If, on the other hand, it is determined at 708 that full pump strokes are (or 100% duty cycle operation is) not desired, routine 700 progresses to 714 to operate the DI pump in a reduced pump stroke or at less than 100% duty cycle. Next, at 716, the controller may energize and close the SACV at a time between BDC position and TDC position of the pump piston in the compression stroke. For example, the DI pump may be operated with a 20% duty cycle wherein the SACV is energized to close when 80% of the compression stroke is complete so that about 20% volume of the DI pump is pumped. In another example, the DI pump may be operated with a 60% duty cycle, wherein the SACV may be closed when 40% of the compression stroke is complete. Herein, 60% of the DI pump volume may be pumped into the DI fuel rail. Routine 700 may then end. It will be noted that a controller, such as controller 12, may command routine 900 which may be stored in non-transitory memory of the controller.

Figure 8:
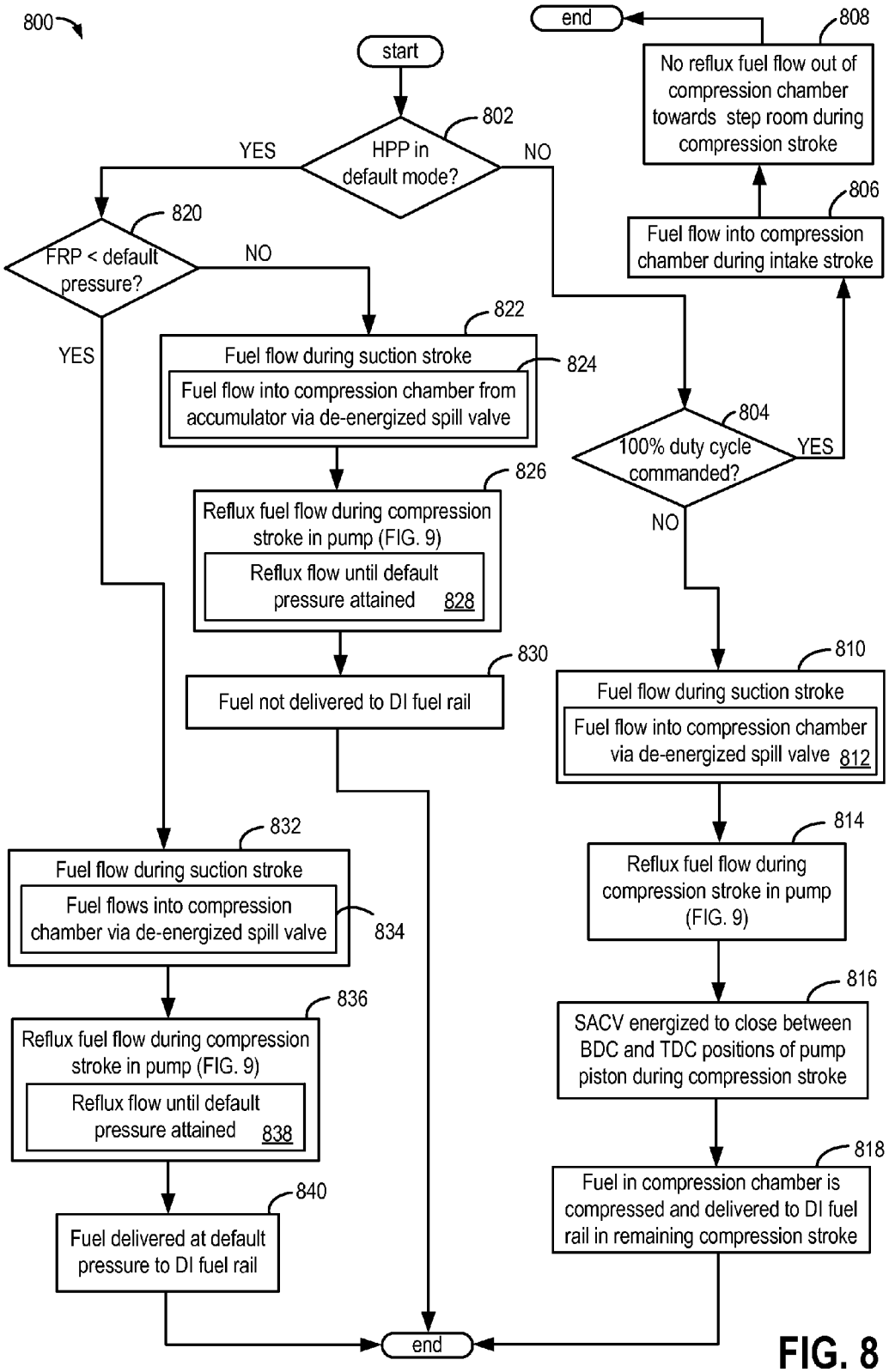
FIG. 8 depicts an example flow chart describing fuel flow within the high pressure pump of FIG. 3 during different modes.
Figure 9:
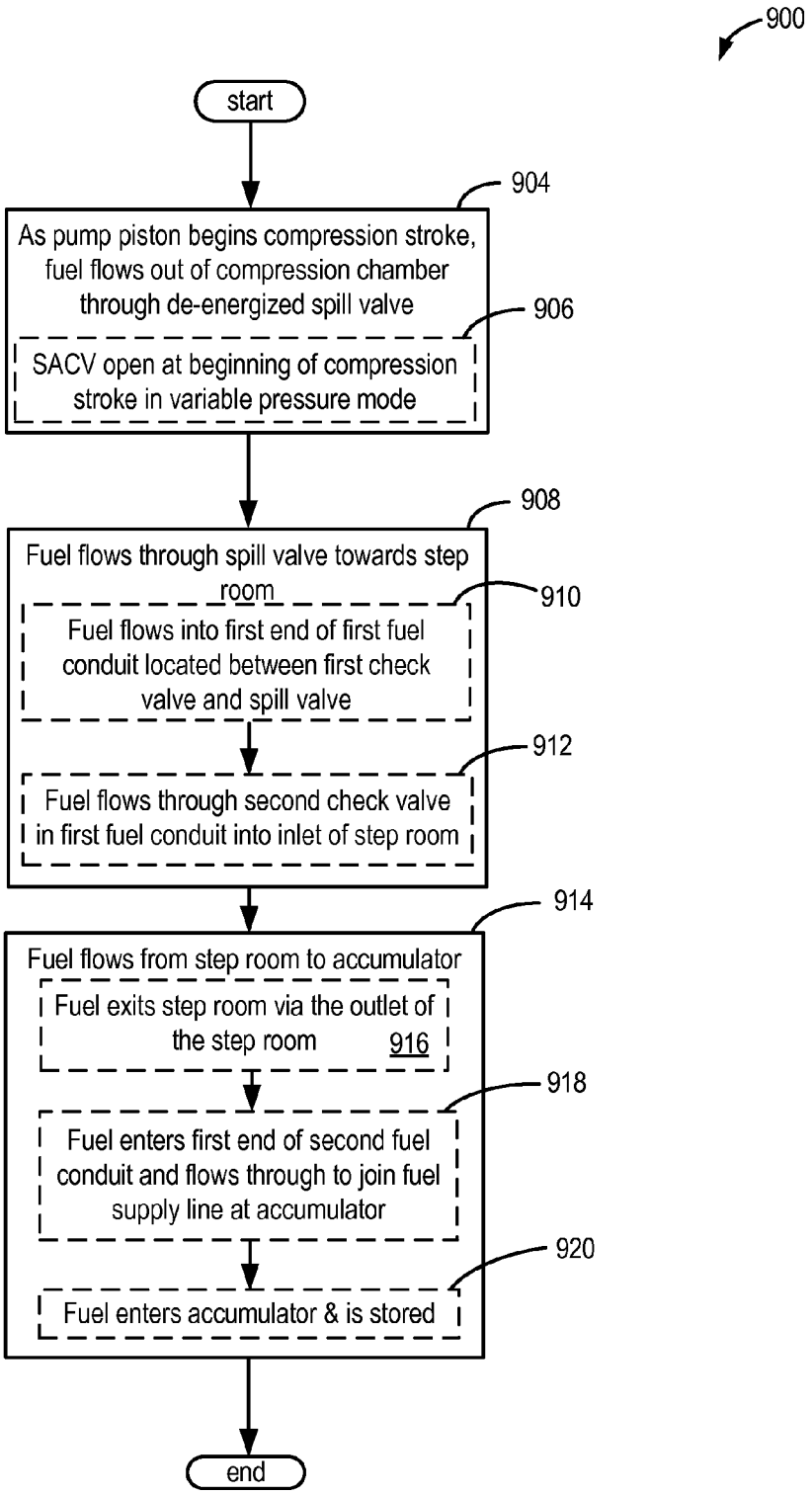
FIG. 9 shows an example flow chart illustrating reflux fuel flow during a compression stroke within the high pressure pump of FIG. 3.

Turning now to FIG. 8, it depicts routine 800 for illustrating example fuel flow in a DI fuel pump (such as DI fuel pump 228) during different modes of DI fuel pump operation in accordance with the present disclosure. Specifically, routine 800 describes example fuel flow in the DI fuel pump during variable pressure mode (with and without full pump strokes) and example fuel flow in the DI fuel pump during a default pressure mode. It will be noted that the controller (such as controller 12) may neither command nor perform routine 800. As such, fuel flow may occur due to hardware within the DI fuel pump (e.g. DI fuel pump 228).

At 802, it may be determined if the DI fuel pump is operating in the default pressure mode. As described earlier, the default pressure mode operation of the DI fuel pump includes deactivating and de-energizing the solenoid activated check valve (SACV) throughout pump operation. Thus, fuel flow may occur to and fro through the SACV (also termed, spill valve), both upstream and downstream of the SACV. If the DI pump is not operating in the default pressure mode, DI pump may be operating in the variable pressure mode wherein the SACV may be activated and energized during at least a portion of the pump stroke.

If it is determined at 802 that the DI pump is not operating in default pressure mode, routine 800 continues to 804 to confirm if a 100% duty cycle operation (full pump stroke) of the DI pump has been commanded. If yes, routine 800 progresses to 806 wherein a suction stroke in the DI fuel pump is determined. During the suction stroke, as described earlier in reference to FIG. 4, fuel may flow into the compression chamber of the DI fuel pump via the SACV 312. SACV 312 may be de-energized to a pass-through state, in one example, during the suction stroke. In another example, SACV may be energized but may function as a check valve enabling fuel flow into the compression chamber but blocking fuel outflow from the compression chamber through SACV 312. Next, at 808, during a subsequent compression stroke in the DI fuel pump, reflux fuel flow from the compression chamber of the DI fuel pump may not occur. To elaborate, a full pump stroke may include closing the SACV (by energizing the SACV) at the beginning of a compression stroke. When the SACV is closed, fuel may not exit the compression chamber through the SACV during the compression stroke and thus, reflux fuel impelled by piston top 305 may not flow towards the step room via the first fuel conduit. Further, as pressure in the compression chamber increases during the compression stroke and exceeds an existing fuel rail pressure in the DI fuel rail, fuel may exit the compression chamber through outlet check valve (e.g., outlet check valve 316) towards the DI fuel rail.

On the other hand, if it is determined at 804 that full pump strokes have not been commanded (e.g., less than 100% duty cycle operation), routine 800 proceeds to 810, wherein fuel flow during a suction stroke may be occurring. As described earlier, in reference to FIG. 4, fuel may enter the compression chamber of the DI fuel pump via the SACV. Further, as noted at 812, fuel may enter the compression chamber via the de-energized SACV (functioning in the pass-through state). The SACV may be de-energized since the DI pump is operating with reduced pump strokes (e.g., less than 100% duty cycle). Thus, a fraction of the fuel drawn into the compression chamber, based on the desired duty cycle, may be expelled out through the SACV in the pass-through state in the following compression stroke.

During the intake stroke, specifically for DI fuel pump 228 of FIG. 3, fuel may be drawn from each of accumulator 330 and the lift pump into the compression chamber 308 of the DI pump. To elaborate, fuel may flow from the first variable volume 340 of accumulator 330, via entrance 332, into passage 348 of accumulator 330, and therethrough into fuel supply line 344 at node 362. Additionally or alternatively, fuel may be drawn into compression chamber 308 from lift pump 208 via inlet 399 of DI fuel pump 228. Fuel drawn in from the accumulator 330 and/or lift pump may flow through fuel supply line 344, past node 362, through first check valve 322, past node 364, and through spill valve 312 into compression chamber 308 of DI fuel pump 228.

At 814, a compression stroke subsequent to the intake stroke at 810 may occur. Further, reflux fuel may flow out of the compression chamber through the de-energized SACV. Additional details of the reflux fuel flow will be described in reference to FIG. 9. Reflux fuel flow may occur from compression chamber 308 through step room 318 of DI fuel pump 228. Further, the reflux fuel may flow from the step room into accumulator 330 of DI fuel pump 228. As such, reflux fuel may flow from the compression chamber 308 to the accumulator 330 only after flowing through step room 318.

Based on the demanded duty cycle, at 816, the SACV may be energized to close. In particular, the spill valve may be energized to close at a point between BDC and TDC positions of the pump piston during the compression stroke. An early closing of the spill valve, relative to the duration of the compression stroke, may be desired for a larger quantity of fuel delivery to the DI fuel rail. A later closing of the spill valve, relative to the duration of the compression stroke, may result in a smaller volume of fuel being delivered to the DI fuel rail.

At 818, once the SACV is closed, fuel flow through the spill valve towards the step room is ceased. Fuel remaining in the compression chamber may now be pressurized and delivered to the DI fuel rail in the remaining compression stroke. Routine 800 may then end.

Returning to 802, if it is determined that the DI pump is operating in the default pressure mode, routine 800 continues to 820 to confirm if fuel rail pressure (FRP) in the DI fuel rail is less than the default pressure of the DI fuel pump. As mentioned earlier, the default pressure of the DI fuel pump may be based on the pressure accumulator, e.g. accumulator 330. If FRP is not lower than default pressure, routine 800 progresses to 822, wherein a suction stroke in the DI fuel pump may be beginning.

Since FRP in the DI fuel rail is higher than the default pressure in the DI fuel pump, reflux fuel from the previous compression stroke may be largely stored in the accumulator. Therefore, the following suction stroke in the DI fuel pump, at 824, may include drawing fuel principally from the accumulator into the compression chamber via the de-energized SACV. Thus, fuel may enter the compression chamber primarily from accumulator 330. To elaborate, stored fuel in the accumulator 330 may flow from the first variable volume 340 of accumulator 330, via entrance 332, into passage 348 of accumulator 330, and therethrough into fuel supply line 344 at node 362. Fuel drawn in from the accumulator 330 may then continue through fuel supply line 344, past node 362, through first check valve 322, past node 364, and through spill valve 312 into compression chamber 308 of DI fuel pump 228.

At 826, a compression stroke subsequent to the intake stroke at 822 may occur. Further, reflux fuel may flow out of the compression chamber through the de-energized SACV. Additional details of the reflux fuel flow will be described in reference to FIG. 9. Reflux fuel flow may occur from compression chamber 308 through step room 318 of DI fuel pump 228. Further, the reflux fuel may flow from the step room into accumulator 330 of DI fuel pump 228. As such, reflux fuel may flow to the accumulator 330 only after flowing through step room 318. At 828, reflux fuel may exit the compression chamber through the spill valve until a default pressure is attained in the DI fuel pump.

Since FRP in the DI fuel rail is higher than the default pressure in the pump, at 830, there may be no fuel delivery to the high pressure fuel rail. Thus, a significant portion of the fuel situated within the compression chamber at the beginning of the compression stroke may be shifted for storage in the accumulator during the compression stroke. This stored fuel may be drawn into the compression chamber in the subsequent intake stroke of the DI fuel pump. Routine 800 may then end.

Returning to 820, if it is determined that the FRP in the DI fuel rail is lower than the default pressure, routine 800 continues to 832. At 832, a suction stroke in the DI fuel pump may be initiated. The suction stroke at 832 may follow a previous compression stroke wherein a quantity of fuel may have been delivered from the compression chamber to the DI fuel rail. Thus, in the suction stroke at 832, fuel may flow into the compression chamber from each of the accumulator and the lift pump. Fuel may be drawn from each of accumulator 330 and the lift pump via the de-energized spill valve, at 834, into the compression chamber 308 of the DI pump. As described earlier, fuel may flow from the first variable volume 340 of accumulator 330, via entrance 332, into passage 348 of accumulator 330, and therethrough into fuel supply line 344 at node 362. Stored fuel from accumulator 330 may continue to flow through first check valve 322, past node 364, via SACV 312 into compression chamber 308. Additional fuel may be drawn into compression chamber 308 from lift pump 208 via pump inlet 399 of DI fuel pump 228. Fuel drawn in from the lift pump may flow through first section 343 of fuel supply line 344, across third check valve 321, past node 362 into fuel supply line 344 and thereon through first check valve 322, past node 364, and through spill valve 312 into compression chamber 308 of DI fuel pump 228.

At 836, a compression stroke subsequent to the intake stroke at 832 may occur. Further, reflux fuel may flow out of the compression chamber through the de-energized SACV. Additional details of the reflux fuel flow will be described in reference to FIG. 9. Reflux fuel flow may occur from compression chamber 308 through step room 318 of DI fuel pump 228. Further, the reflux fuel may flow from the step room into accumulator 330 of DI fuel pump 228. At 838, reflux fuel may exit the compression chamber through the spill valve until a default pressure is attained in the DI fuel pump. Once default pressure is attained in the DI fuel pump, fuel may exit the compression chamber towards the DI fuel rail, at 840. Since FRP in the DI fuel rail is lower than the default pressure in the DI fuel pump, fuel may be delivered from the compression chamber via the outlet check valve to the DI fuel rail. Routine 800 may then end. FIG. 9 depicts an example routine 900 describing fuel flow during a compression stroke in the DI fuel pump embodiment of FIG. 3, when the spill valve is in the pass-through state. Specifically, reflux fuel flowing out from the compression chamber through the spill valve is directed towards the step room of the DI pump for cooling. Further, the reflux fuel is returned to the fuel supply line at the accumulator, upstream of the spill valve, only after flowing through the step room. Routine 900 may not be initiated by the controller nor are instructions for routine 900 stored in the controller. As such, routine 900 may occur due to the design of the DI pump system and the hardware included within.

A compression stroke in the DI fuel pump may be initiated wherein reflux fuel flow may occur from the compression chamber through the spill valve during default pressure mode of operation and during a lower than 100% duty cycle operation of the DI fuel pump. At 904, as the pump piston begins the compression stroke and moves towards TDC position, the pump piston forces fuel from within the compression chamber towards the spill valve (also termed, solenoid activated check valve). Since the spill valve is de-energized and in the pass-through state, fuel exits the compression chamber (as reflux fuel).

At 906, the spill valve may be open at the beginning of the compression stroke in the variable pressure mode when the DI pump is operating with reduced pump strokes (e.g. less than 100% duty cycle). As fuel exits the compression chamber through the spill valve, at 908, fuel flow is directed towards the step room. As described earlier in reference to FIGS. 3 and 5, first check valve 322 obstructs reverse fuel flow from SACV 312 towards accumulator 330 (or LPP 208). Therefore, reflux fuel flow is directed through the first fuel conduit 376 towards the step room 318. At 910, fuel exiting the spill valve (e.g., SACV 312) may be drawn into the first fuel conduit via the first end of the first fuel conduit (e.g., first end 372 of first fuel conduit 376). As described earlier in reference to FIG. 3, the first end 372 of the first fuel conduit may be fluidically coupled to the fuel supply line 344 at node 364 between first check valve 322 and spill valve 312.

Next at 912, reflux fuel may flow within the first fuel conduit through second check valve (e.g., second check valve 324) and enter the inlet (e.g., inlet 352) of step room 318. As such, fuel may flow via the second end 374 of the first fuel conduit 376 into step room 318. As the fuel flows through the step room, the heated piston bottom (e.g., 307) may be cooled. Further, the step room 318 may also be cooled reducing vaporization of fuel. At 914, the reflux fuel may exit the step room and may be conducted to the accumulator 330. Specifically, at 916, reflux fuel may exit step room 318 at its outlet 354. Next at 918, this reflux fuel may enter second fuel conduit 356 via the first end 355 of the second fuel conduit 356 and may be returned to the fuel supply line 344 at node 362. Further, at 920, reflux fuel may be transferred for storage to accumulator 330 from node 362. To elaborate, the reflux fuel may travel through second fuel conduit 356, and may exit into fuel supply line 344 at accumulator 330 (e.g., at node 362 downstream of third check valve 321 and upstream of first check valve 322) via the second end 357 of the second fuel conduit. Further still, the reflux fuel may then flow via passage 348 of accumulator 330 and may reside in first variable volume 340 of accumulator 330 during a remainder of the compression stroke.

Thus, an example method may comprise, when a solenoid activated check valve is in a pass-through state, flowing reflux fuel from a compression chamber of a direct injection fuel pump via the solenoid activated check valve and through a step room into an accumulator, the reflux fuel flowing into the accumulator only after flowing through the step room.

In this manner, an example DI fuel pump may enable circulation of fuel through its step room by positively pumping fuel from the compression chamber of the DI fuel pump to the step room of the DI pump through a de-energized spill valve and via the first fuel conduit. The circulation of fuel through the step room may largely occur during a compression stroke in the DI fuel pump. Fuel may flow through the step room towards the accumulator for storage during a remainder portion of the compression stroke. The stored fuel may be returned to the compression chamber in a subsequent intake stroke of the DI fuel pump.

In this way, heating of fuel within a step room in a direct injection fuel pump may be reduced. By initiating fuel circulation through the step room using pump strokes in a compression chamber of the direct injection fuel pump, a direct injection fuel pump including a wider piston stem may be adequately cooled. Accordingly, adverse effects of fuel overheating such as fuel vaporization, resulting reduced lubrication, seizing of the pump piston in the bore, etc. may be diminished. Thus, pump performance may be enhanced while extending an operating life of the direct injection fuel pump.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a compression stroke of a direct injection pump when a spill valve is in a pass-through state, circulating a portion of fuel from a compression chamber of the direct injection pump to a step room of the direct injection pump, the circulating including flowing the portion of fuel through the spill valve and drawing the portion of fuel into the step room from upstream of the spill valve and downstream of an accumulator, the accumulator positioned upstream of the spill valve with a first check valve positioned between the accumulator and the spill valve; and returning the portion of fuel exiting the step room through a fuel supply line to the accumulator upstream of the first check valve.

2. The method of claim 1, wherein the drawing of the portion of fuel into the step room from upstream of the spill valve and downstream of an accumulator includes drawing the portion of fuel from upstream of the spill valve and downstream of the first check valve.

3. The method of claim 2, wherein the portion of fuel drawn into the step room from upstream of the spill valve and downstream of the first check valve flows through a second check valve, the second check valve arranged upstream of the step room.

4. The method of claim 3, wherein the portion of fuel includes reflux fuel from the compression chamber.

5. The method of claim 1, wherein the portion of fuel is substantially stored in the accumulator during a period of the compression stroke, and wherein the portion of fuel is released during a duration of a suction stroke in the direct injection pump.

6. The method of claim 1, wherein the direct injection pump includes a pump piston coupled to a piston stem, the piston stem having an external diameter that is substantially the same as an external diameter of the pump piston.

7. The method of claim 1, wherein the direct injection pump includes a pump piston coupled to a piston stem, the piston stem having an external diameter that is substantially half of an external diameter of the pump piston.

8. A method, comprising:

when a solenoid activated check valve is in a pass-through state, flowing reflux fuel from a compression chamber of a direct injection fuel pump via the solenoid activated check valve and through a step room into an accumulator, the reflux fuel flowing into the accumulator only after flowing through the step room, wherein the accumulator is arranged upstream of each of a first check valve and the solenoid activated check valve.

9. The method of claim 8, wherein the reflux fuel flows from the compression chamber via the solenoid activated check valve into the step room via a second check valve in a passage, an inlet of the passage fluidically coupled between the first check valve and the solenoid activated check valve.

10. The method of claim 8, wherein the flowing of the reflux fuel occurs substantially during a compression stroke in the direct injection fuel pump.

11. A system, comprising:

an engine;

a lift pump;

a direct injection fuel pump including a piston coupled to a piston stem, a compression chamber, a step room, and a cam for driving the piston;

a high pressure fuel rail fluidically coupled to an outlet of the direct injection fuel pump;

a solenoid activated check valve positioned at an inlet of the direct injection fuel pump;

a fuel supply line fluidically coupling the lift pump and the solenoid activated check valve;

an accumulator positioned upstream of the solenoid activated check valve, the accumulator fluidically communicating with the fuel supply line;

a first check valve coupled to the fuel supply line between the accumulator and the solenoid activated check valve;

a first fuel conduit including a second check valve;

a first end of the first fuel conduit fluidically coupled to the fuel supply line between the first check valve and the solenoid activated check valve;

a second end of the first fuel conduit fluidically coupled to an inlet of the step room;

a second fuel conduit;

a first end of the second fuel conduit fluidically coupled to an outlet of the step room; and a second end of the second fuel conduit fluidically coupled to the fuel supply line at the accumulator upstream of the first check valve and downstream of a third check valve.

12. The system of claim 11, further comprising a controller having executable instructions stored in a non-transitory memory for de-energizing the solenoid activated check valve to function in a pass-through state.

13. The system of claim 12, wherein during a portion of a compression stroke in the direct injection fuel pump, reflux fuel from the compression chamber flows to the step room via the solenoid activated check valve in the pass-through state, into the first end of the first fuel conduit, through the second check valve, and via the second end of the first fuel conduit into the inlet of the step room.

14. The system of claim 13, wherein the reflux fuel further streams from the outlet of the step room into the first end of the second fuel conduit towards the accumulator and the fuel supply line via the second end of the second fuel conduit.

15. The system of claim 14, wherein the solenoid activated check valve is de-energized for an entire pump stroke during a default pressure mode of operation of the direct injection fuel pump.

16. The system of claim 14, wherein the solenoid activated check valve is de-energized for a portion of a pump stroke during a variable pressure mode of operation of the direct injection fuel pump.

* * * * *